US010804057B2

(12) United States Patent
Ledbetter

(10) Patent No.: US 10,804,057 B2
(45) Date of Patent: Oct. 13, 2020

(54) METHOD FOR REPLACEMENT OF MERCURY SWITCHES IN A SWITCHGEAR WITH ALTERNATIVE SWITCH TYPES

(71) Applicant: Vacuum Interrupters, Inc., Farmers Branch, TX (US)

(72) Inventor: Finley Lee Ledbetter, Argyle, TX (US)

(73) Assignee: Vacuum Interrupters, Inc., Farmers Branch, TX (US)

( * ) Notice: Subject to any disclaimer, the term of this patent is extended or adjusted under 35 U.S.C. 154(b) by 0 days.

(21) Appl. No.: 16/249,713

(22) Filed: Jan. 16, 2019

(65) Prior Publication Data

US 2019/0221387 A1 Jul. 18, 2019

Related U.S. Application Data

(60) Provisional application No. 62/618,452, filed on Jan. 17, 2018.

(51) Int. Cl.
*H01H 35/02* (2006.01)

(52) U.S. Cl.
CPC ..... *H01H 35/027* (2013.01)

(58) Field of Classification Search
CPC ..... H01H 35/027
See application file for complete search history.

(56) References Cited

U.S. PATENT DOCUMENTS 4,820,888 A * 4/1989 Shields ..... H01H 35/022 200/61.45 M
5,065,844 A * 11/1991 Hon ..... B66B 9/04 187/275
5,373,125 A * 12/1994 Ford ..... H01H 35/022 200/61.52
6,005,205 A * 12/1999 Chou ..... H01H 35/02 200/61.45 M
6,140,635 A * 10/2000 Kazumi ..... G01C 9/10 200/61.45 R
6,348,665 B1 * 2/2002 Ohashi ..... H01H 35/02 200/61.45 R
6,858,835 B2 * 2/2005 Smith ..... H03K 17/968 250/231.1
2010/0243413 A1 * 9/2010 Chu ..... H01H 35/02 200/61.52
2015/0021298 A1 * 1/2015 Sawada ..... H01H 31/003 218/140

* cited by examiner

*Primary Examiner* — Kyung S Lee
(74) *Attorney, Agent, or Firm* — Foley & Lardner LLP

(57) ABSTRACT

For replacing position detecting switches in a breaker, a mechanical breaker switch is moved to permit removal of first and second position detecting switches, the first indicating whether the mechanical breaker switch is in a first position by transitioning between first and second states when disposed at or greater than a first threshold angle, the second indicating whether the mechanical breaker switch is in the second position by transitioning between first and second states when disposed at or less than a second threshold angle. The position detecting switches are removed and replaced with replacement position detecting switches. The first replacement switch is adjusted to transition between the first and second states at when disposed at or greater than the first threshold angle, and the second replacement switch is adjusted to transition between the first and second states at when disposed at or less than the second threshold angle.

12 Claims, 25 Drawing Sheets

METHOD FOR REPLACEMENT OF MERCURY SWITCHES IN A SWITCHGEAR WITH ALTERNATIVE SWITCH TYPES

PRIOR RELATED APPLICATIONS

This application claims benefit of and priority to U.S. Provisional Patent Application Ser. No. 62/618,452 entitled "Method for Replacement of Mercury Switches in Switchgear with Alternative Switch Types," filed on Jan. 17, 2018.

FEDERALLY SPONSORED RESEARCH STATEMENT

N/A

REFERENCE TO MICROFICHE APPENDIX

N/A

FIELD OF INVENTION

This disclosure is related to the field of switchgear apparatuses, and in particular, to replacement of mercury switches in a switchgear apparatus with alternative switch types, without requirement for adjustment of the switchgear apparatus itself.

BACKGROUND OF THE INVENTION

Switchgear apparatuses are used as circuit breakers in industrial settings to switch power to certain circuits on or off. One commonly used type of switchgear apparatus utilizes an electric motor to move a mechanical breaker switch (mechanical switch, circuit breaker, etc.) into a bus for operation or out of the bus for non-operation (also known as "racking" the switch). When racked into the electrical bus, the mechanical breaker switch is installed and in position for operation as a circuit breaker. After racking-in the mechanical breaker switch, its electrical contacts can be moved into the closed position, where the mechanical breaker switch engages with corresponding electrical contacts so as to close the mechanical breaker switch and thereby complete a circuit. In operation, the electrical contacts can also be tripped or moved into the open position, where the electrical contacts are not engaged, resulting in the mechanical breaker switch being opened, and the circuit not being powered. When racked-out of the electrical bus, the mechanical breaker switch is not in operation and can be serviced or replaced.

So as to prevent overtravel by the mechanical breaker switch when racking it into or out of the bus, first and second position detection switches are used. When the mechanical breaker switch engages the first position detection switch (during rack-in travel) in a fashion sufficient to change state of the first position detection switch, the movement of the mechanical breaker switch into the bus by the electric motor is stopped. Likewise, when the mechanical breaker switch engages the second position detection switch (during rack-out travel) in a fashion sufficient to change state of the second position detection switch, the movement of the mechanical breaker switch by the electric motor is stopped.

The position detection switches in such switchgear apparatuses, particularly those switchgear apparatuses manufactured in the past, are mercury type tilt switches. Since it may now be desirable to replace these position detection switches with another type of tilt switch, such as one that is not mercury based, techniques for performing this replacement while not compromising operation of the switchgear apparatus are needed.

SUMMARY OF THE INVENTION

Disclosed herein is a method of replacing position detection switches in a breaker apparatus including a mechanical breaker switch that is movable between first and second position. The method includes moving the mechanical breaker switch to a position permitting removal of a first position detecting switch from a first support, with the first position detecting switch indicating whether the mechanical breaker switch is in the first position by transitioning between first and second states when disposed at or greater than a first threshold angle with respect to gravity. The first position detecting switch is removed and replaced with a first replacement position detecting switch without adjusting an angle of the first support with respect to gravity. The first replacement position detecting switch is adjusted such that it transitions between the first and second states at when disposed at or greater than the first threshold angle with respect to gravity, without adjusting the angle of the first support with respect to gravity.

Adjustment of the first replacement position detecting switch may be connecting a test device to the first replacement position detecting device, with the first replacement position detecting device indicating whether the first replacement switch is in first state or the second state. Adjusting the first replacement position detecting switch may include rotating the first replacement position detection switch until the test device indicate that the first replacement position detecting device transitions between the first and second states when disposed at or greater than the first threshold angle with respect to gravity.

Adjusting the first replacement position detecting switch may additionally or alternatively include disposing a sleeve about an exterior of the first replacement position detecting switch prior to replacement of the first position detecting switch with the first replacement position detecting switch, and testing whether the test device indicates that the first replacement position detecting device transitions between the first and second states when disposed at or greater than the first threshold angle with respect to gravity.

The first position detecting switch may be rated to handle a first voltage sufficient to control a motor that moves the mechanical breaker switch between the first and second positions, and the first replacement position detecting device may be rated to handle a second voltage lower than the first voltage and insufficient to control the motor. Control circuitry may be coupled to the first replacement position detecting switch so as to permit the first replacement position detecting device to control the motor.

The method may include removing a second position detecting switch that indicates whether the mechanical breaker switch is in the second position by transitioning between the first and second states when disposed at or less than a second threshold angle with respect to gravity. The second position detecting switch is replaced with a second replacement position detecting switch. The second replacement position detecting switch is adjusted such that it transitions between the first and second states at when disposed at or less than the second threshold angle with respect to gravity.

Removing the first position detecting switch may be removing a first position detecting switch of a first switch type, and replacing the first position detecting switch with the first replacement position detecting switch may be replacing the first position detecting switch of the first type with a first replacement position detecting switch of a second type different than the first type.

Replacing the first position detecting switch with the first replacement position detecting switch may be replacing the first position detecting switch with a first replacement position detecting switch of a same type as the first position detecting switch.

Also disclosed herein is an apparatus including a housing having a central opening defined therein, and a tilt activated switch disposed within the central opening of the housing. The central opening is angled with respect to a longitudinal axis of the housing such that rotation of the housing changes the angle of the tilt activated switch with respect to gravity.

The tilt activated switch may be of a rolling ball type, a mercury type, or any other suitable type.

The tilt activated switch may be rated to handle a second voltage. Control circuitry may be coupled to the tilt activated switch and enable the tilt activated switch to serve a load requiring a first voltage greater than the second voltage.

The control circuitry includes a voltage converter configured to convert the first voltage to the second voltage, and a relay circuit powered by the voltage converter and configured to switch an electric motor.

Also disclosed herein is a breaker apparatus including a mechanical breaker switch movable between racked-in and racked-out positions, an electric motor configured to move the mechanical breaker switch between the racked-in and racked-out when powered by a first voltage, and a first position detection apparatus. The first position detection apparatus includes a first support biased toward the closed position of the mechanical breaker switch and a first position detecting switch carried by the first support and for indicating whether the mechanical breaker switch is in the racked-out position, the first position detecting switch rated to handle a second voltage less than the first voltage. The first position detecting switch is adjustable so as to permit change of an angle thereof with respect to gravity without changing an angle of the first support with respect to gravity. Control circuitry includes a voltage converter configured to convert the first voltage to the second voltage, and a relay circuit powered by the voltage converter and configured to switch the electric motor.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present invention, reference should be made to the following detailed disclosure, taken in conjunction with the accompanying drawings, in which like parts are given like reference numerals, and wherein.

DETAILED DESCRIPTION OF EMBODIMENTS OF THE INVENTION

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

In the following detailed description and the attached drawings, specific details are set forth to provide a thorough understanding of the present disclosure. However, those skilled in the art will appreciate that the present disclosure may be practiced, in some instances, without such specific details. In other instances, well-known elements have been illustrated in schematic or block diagram form in order not to obscure the present disclosure in unnecessary detail. Additionally, for the most part, specific details, and the like, have been omitted inasmuch as such details are not considered necessary to obtain a complete understanding of the present disclosure, and are considered to be within the understanding of persons of ordinary skill in the relevant art.

Figure 1:
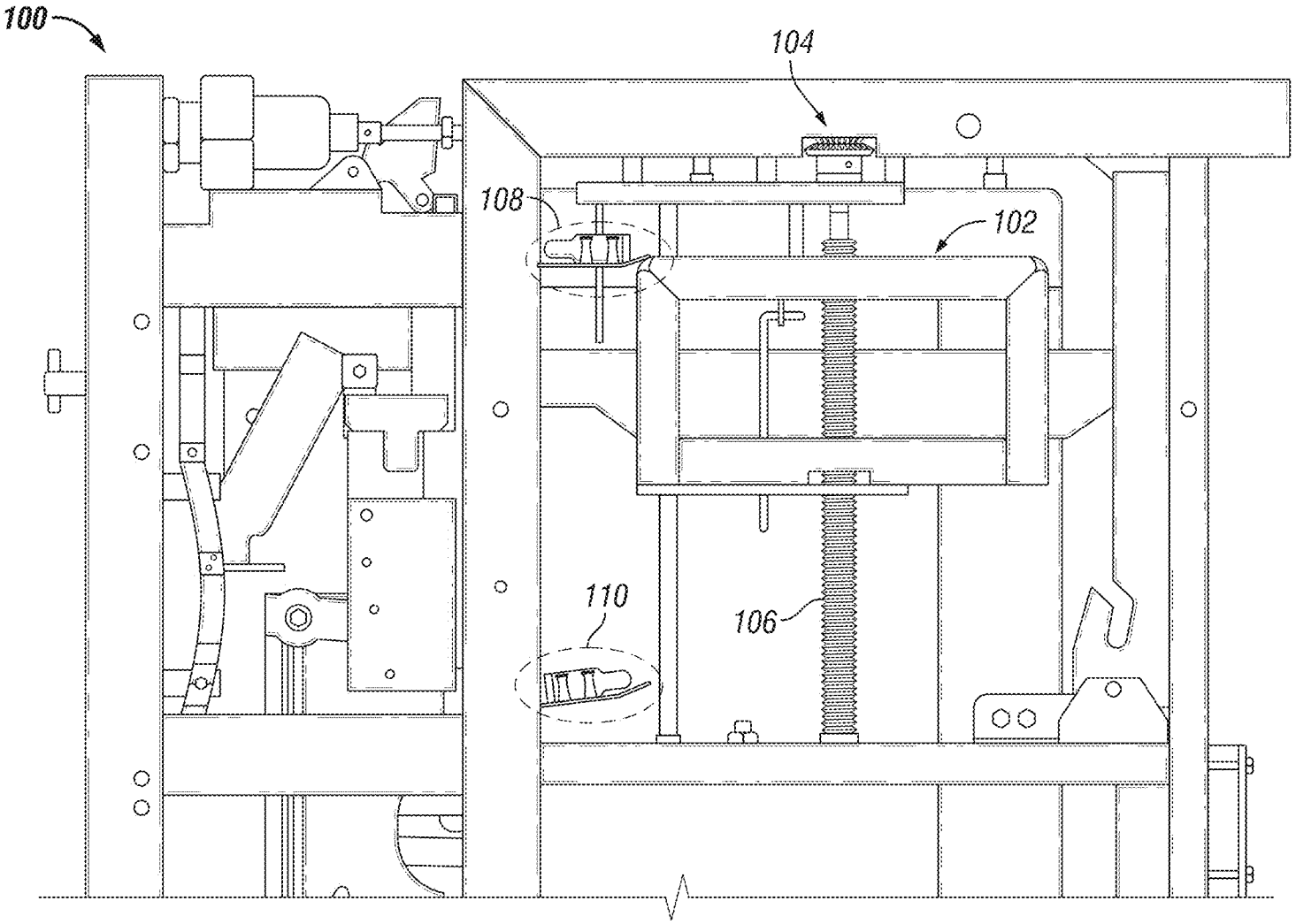
FIG. 1 is a front view of a switchgear apparatus on which the methods of this disclosure may applied and with which the devices of this disclosure may operate.
Figure 2:
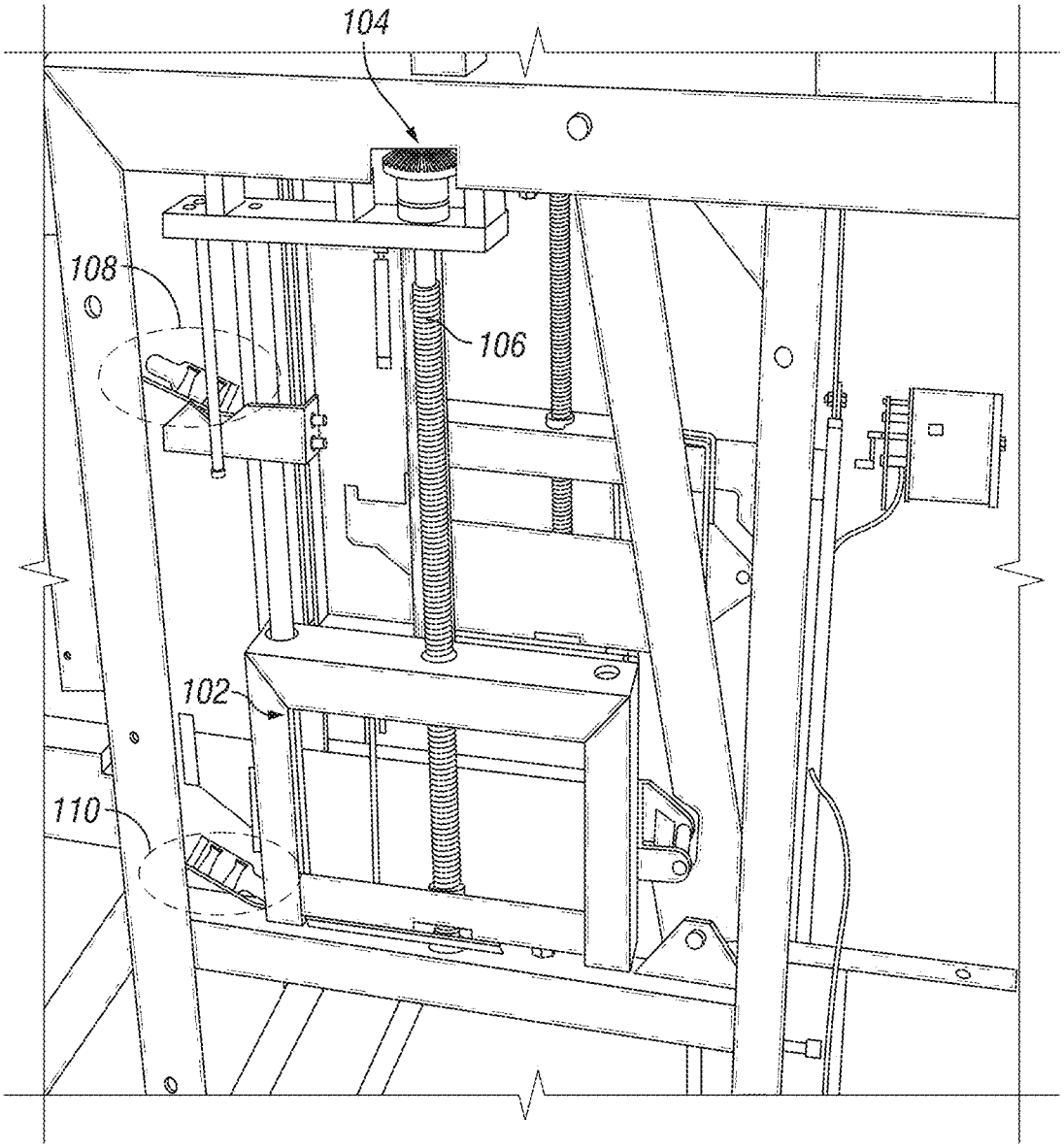
FIG. 2 is a perspective view of a switchgear apparatus on which the methods of this disclosure may applied and with which the devices of this disclosure may operate.

Referring initially to FIGS. 1-2, a breaker apparatus 100 is now described. The breaker apparatus 100 includes a mechanical breaker switch 102 that is raised and lowered via rotation of a threaded shaft 106. An electric motor 104 rotates the shaft 106 so as to move the mechanical breaker switch 102 between first and second positions, which may be the racked-in and racked-out positions. In the breaker apparatus 100 shown, the first position, or racked-in position, in which the mechanical breaker switch 102 connects a circuit, is when the mechanical breaker switch 102 is in its uppermost position, as shown in FIG. 1. The second position, or racked-out position for the breaker apparatus 100, in which the mechanical breaker switch 102 breaks the circuit, is when the mechanical breaker switch 102 is in its lowermost position, as shown in FIG. 2.

Since it is desirable for the movement of the mechanical breaker switch 102 to stop when it is in the desired position to thereby prevent overtravel, position detecting switch apparatuses 108 and 110 are used to determine when the mechanical breaker switch 102 is in the desired position. In particular, the upper position detecting switch apparatus 108 detects when the mechanical breaker switch 102 is in a racked-in (ready for operation) position or detects when the mechanical breaker switch 102 is not in the racked-in position. The lower position detecting switch apparatus 110 detects when the mechanical breaker switch 102 is in the racked-out (not ready for operation) position or detects when the mechanical breaker switch 102 is not in the racked-out position.

The electric motor 104 ceases running based upon the inputs received from the position detecting switch apparatuses 108 and 110. For example, if the electric motor 104 is commanded to rack-in the mechanical breaker switch 102, it rotates the threaded shaft 106 so as to raise the mechanical breaker switch 102 (in the direction opposite to gravity), and ceases rotation when the position detecting switch apparatus 108 opens. Similarly, if the electric motor 104 is commanded to rack-out the mechanical breaker switch 102, it rotates the threaded shaft 106 so as to lower the mechanical breaker switch 102 (in the direction toward gravity) and ceases rotation when the position detecting switch apparatus 110 opens. Thus, overtravel of the mechanical breaker switch 102 is prevented. It should be noted that the opening or closing of the position detecting switch apparatuses (108 and 110) may be configured to have the electric motor (104) engage or disengage for either of the opening or closing operations, depending on the setup of the switch apparatuses.

Figure 3:
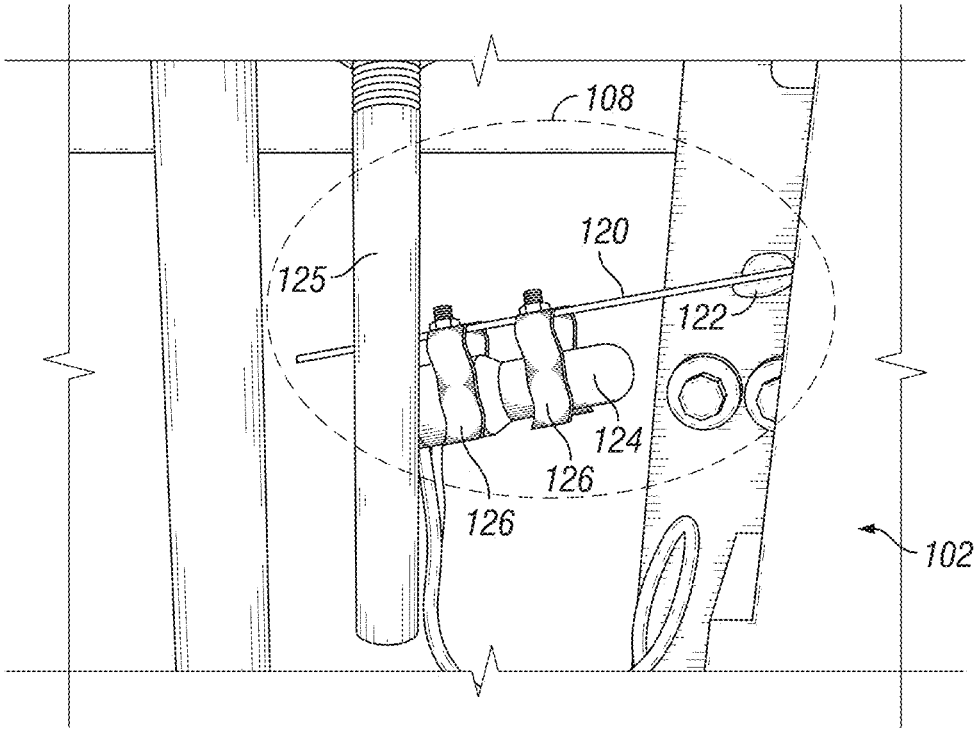
FIG. 3 is a close up front view of replacement upper position detecting switches for FIGS. 1-2.

This operation is best shown in FIGS. 3-6. In FIG. 3, in which the upper position detecting switch apparatus 108 is in the opened position (and thus the mechanical breaker switch 102 is in the racked-in position), it can be seen that the upper position detecting switch apparatus 108 includes a support 120 having a proximal and distal ends. The proximal end of the support 120 is affixed to an anchor 125 and the support 120 extends outwardly away from the anchor 125 toward the distal end. The support 120 has clamps 126 affixed thereto, and the clamps 126 securely hold the upper position detecting switch 124 itself. The distal end of the support 120 is biased into a downward position with respect to the proximal end, in the absence of outside forces.

Figure 5:
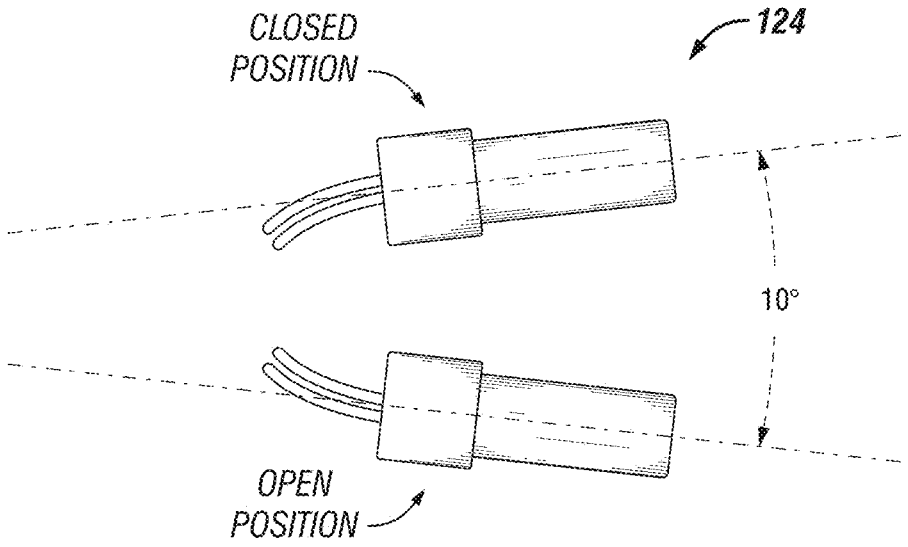
FIG. 5 is a block diagram showing movement of the replacement upper position detecting devices for FIGS. 1-2 between open and closed positions.
Figure 6:
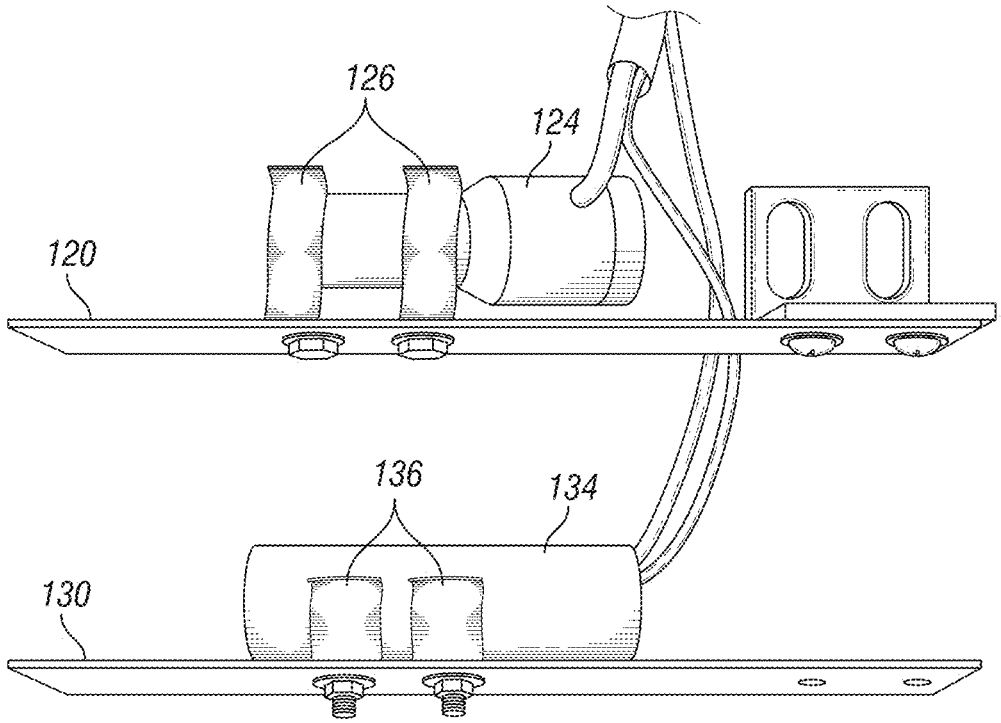
FIG. 6 includes close up front views of the replacement upper and lower position detecting switches of FIGS. 1-2, as installed in their supports.

An engagement tab 122 extends from the side of the mechanical breaker switch 102 proximate to the support 120, and engages with the support 120 (as shown) as the mechanical breaker switch 102 is raised into the racked-in position. As can be seen in FIG. 5, in the closed position, the distal end of the support faces downward with respect to the proximal end when it is closed, and faces upward with respect to the proximal end when it is opened. As the support 120 engages the engagement tab 122 as the mechanical breaker switch 102 is raised into the racked in position, the force exerted on the support 120 forces the support 120 upward, until the angle of the distal end of the support 120 with respect to the proximal end is sufficient to cause the upper position detecting switch 124 to open, at which point the electric motor 104 ceases motion. As shown in FIG. 5, in some cases, the proximal end of the upper position detector 124 may be angled upwardly by the support from its original position by about ten degrees for the upper position detecting switch 124 to open.

Figure 4:
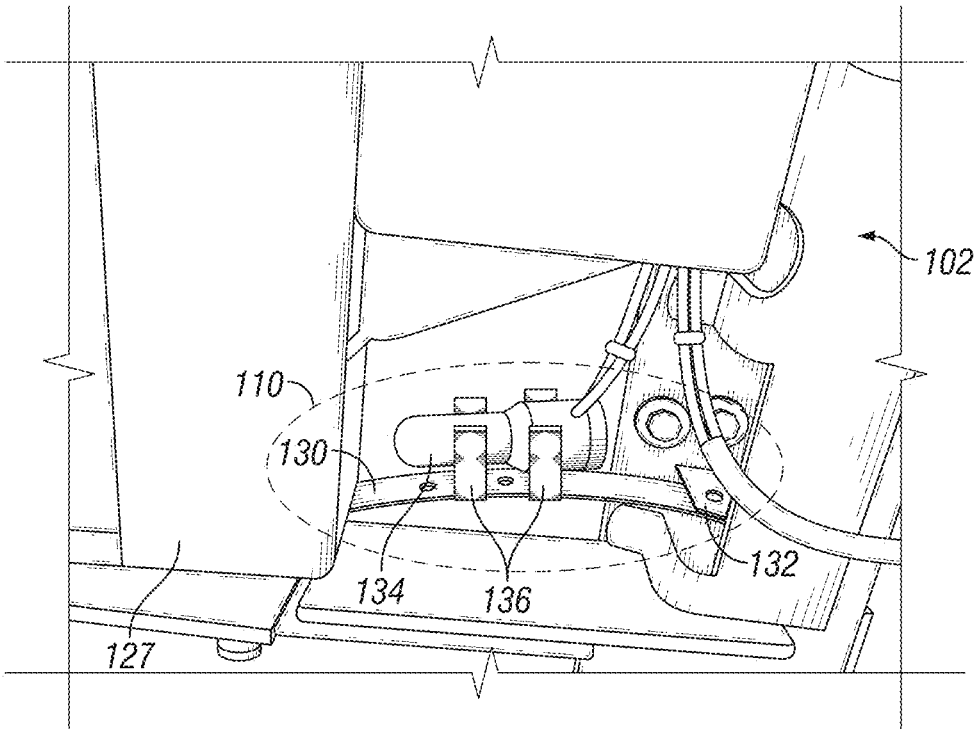
FIG. 4 is a close up front view of replacement lower position detecting switches for FIGS. 1-2.

In FIG. 4, in which the lower position detecting switch apparatus 110 is in the opened position (and thus the mechanical breaker switch 102 is in the racked-out position), it can be seen that the lower position detecting switch apparatus 110 includes a support 130 having a proximal end and a distal end. The proximal end is affixed to anchor 127 and the support 130 extends outwardly from the anchor 127 toward the distal end. The support 130 has clamps 136 affixed thereto, and the clamps 136 securely hold the lower position detecting switch 134 itself. The distal end of the support 130 is biased into an upward position with respect to the proximal end in the absence of outside forces.

An engagement tab 132 extends from the side of the mechanical breaker switch 102 proximate to the support 130, and engages with the support 130 (as shown) as the mechanical breaker switch 102 is lowered into the racked-out position. As the support 130 engages the engagement tab 132 as the mechanical breaker switch 102 is lowered into the racked-out position, the force exerted on the support 130 forces the support 130 downward, until the angle of the distal end of the support 130 with respect to the proximal end is sufficient to cause the lower position detecting switch 134 to open, at which point the electric motor 104 ceases motion. As shown in FIG. 5, in some cases, the distal end of the support may be angled downwardly from its original position with respect to the proximal end by about ten degrees for the lower position detecting switch 134 to close.

The upper position detecting switch apparatus 108 and lower position detecting switch apparatus 110 on commonly used breaker apparatuses in the industry (such as the General Electric Magne-blast) are mercury based tilt switches. Due to concerns about mercury vial breakage, it may be desirable to replace mercury based tilt switches with other types of tilt switches, such as rolling ball based tilt switches, low volume mercury based tilt switches, or other suitable types of tilt switches.

Therefore, the Inventor has found it useful to remove existing mercury based tilt switches in the position detecting switch apparatuses 108 and 110 in such breaker apparatuses, in particular the General Electric Magne-blast, and to replace those mercury based tilt switches with rolling ball or low volume mercury based tilt switches 124, 134. However, rolling ball based tilt switches typically have lower voltage ratings than mercury based tilt switches.

Figure 10:
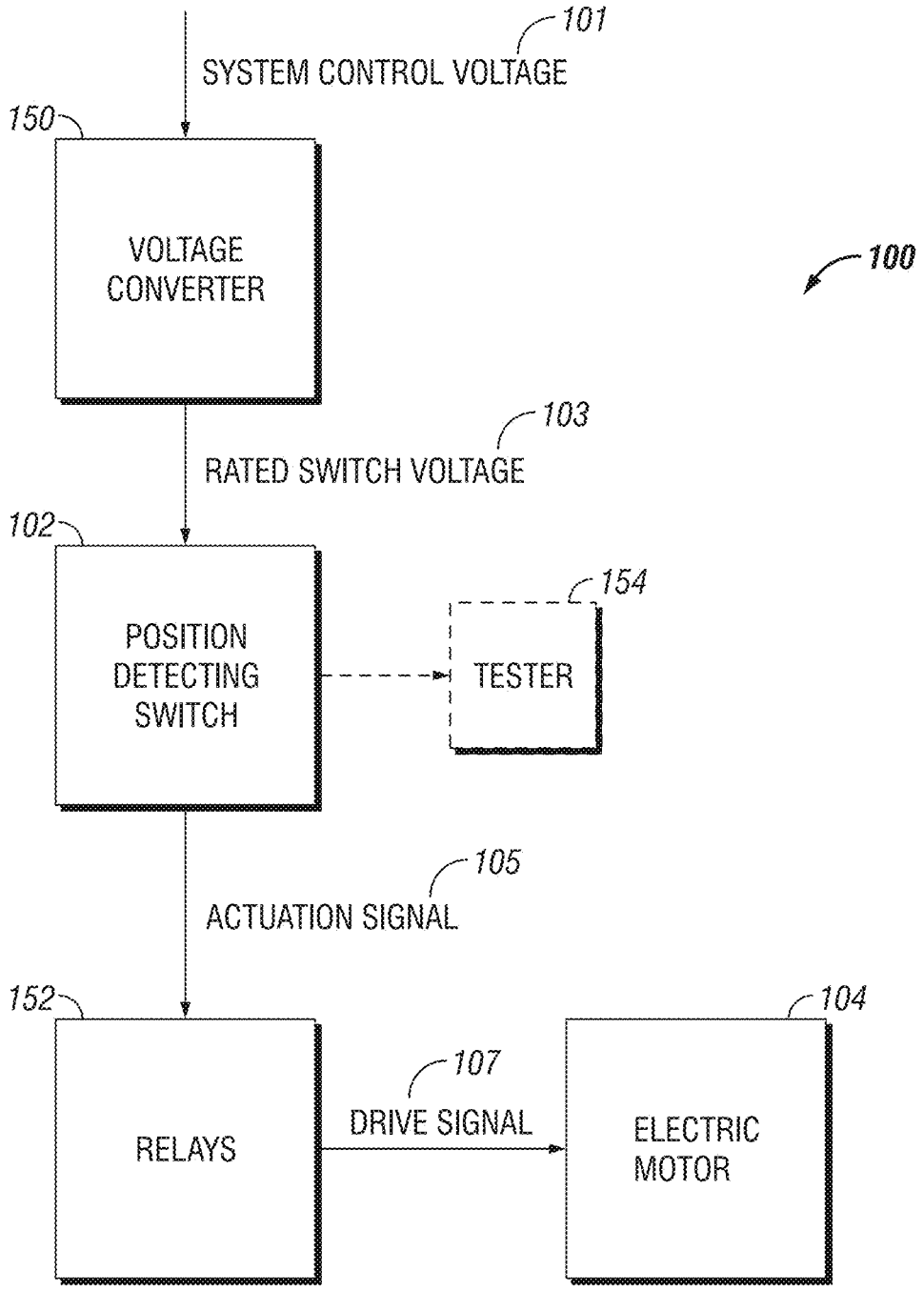
FIG. 10 is a block diagram of the electric motor, mechanical breaker switched moved by the motor, replacement upper position detecting switch, and control circuitry enabling the upper position detecting switch to function with the system control voltage, in accordance with this disclosure.

Therefore, as shown in FIG. 10, the Inventor has designed a control circuit comprised of a voltage converter 150 and relays 152 that enable lower voltage rated rolling ball based tilt switches to be used in place of higher voltage rates mercury based tilt switches. The voltage converter 150 receives the system control voltage 101 that would previously be fed directly to a mercury based tilt switch, and transforms the system control voltage 101 down to the rated voltage 103 for the switch. However, the rated voltage for the rolling ball based tilt switch is insufficient to properly run the electric motor 104. Therefore, each rolling ball based tilt switch 124, 134 is used to actuate a relay 152, or other operable device, which in turn effectuates delivery of the system control voltage 101 to the electric motor 104.

While the replacement of the mercury based tilt switches in the position detecting switch apparatuses 108 and 110 with the rolling ball based tilt switches 124 and 134, in conjunction with the use of the voltage converter 150 and the relays 152, is effective in some scenarios, in other scenarios such direct replacement may require adjustment of the angle of the distal ends of supports 120 and 130 with respect to their proximal ends when in their resting positions so as to ensure that the replacement switches actuate at the proper positions. This not only may be difficult for a technician to accomplish, but due to the age of many commonly used breaker apparatuses, may result in the supports 120 and 130 being broken, resulting in a time consuming repair.

Figure 7:
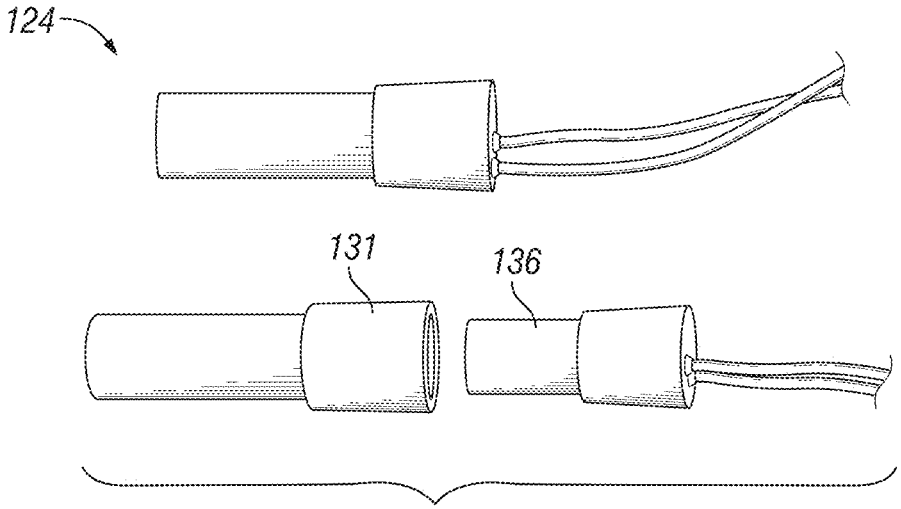
FIG. 7 is an exploded view of the replacement upper position detecting switch of FIGS. 1-2.

As a consequence, the Inventor has designed new rolling ball based tilt switches 124, 134 that may be adjusted, without requiring any adjustment or alteration of the supports 120, 130, so as to ensure actuation at the proper positions. These designs are shown in FIGS. 7-9.

Although only the rolling ball based tilt switch 124 will be described for brevity, it should be understood that the rolling ball based tilt switch 134 will have the same design. In FIG. 9, it can be observed that each rolling ball based tilt switch 124 is comprised of a housing 131 with an opening defined therein that receives a rolling ball based tilt switch unit 136.

Figure 8:
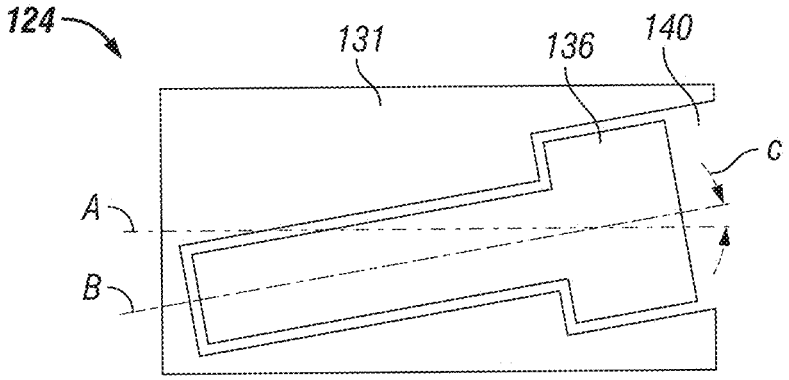
FIG. 8 is a cutaway view of one embodiment of replacement upper position detecting switches for use in FIGS. 1-2.

As shown in FIG. 8, in one embodiment, the opening 140 defined in the housing 131 is angled with respect to a longitudinal axis (reference A) of the housing 131 itself. This way, when the rolling ball based tilt switch unit 136 is placed into the opening 140 of the housing 131, the longitudinal axis (reference B) of the rolling ball based tilt switch unit 136 is angled at angle C with respect to the longitudinal axis (reference A) of the housing 131. Consequently, once the rolling ball based tilt switch 124 is placed into the clamps 126 of the support 120, the angle of the contacts of the rolling ball based tilt switch unit 136 with respect to gravity may be adjust by simply rotating the housing 131 of the rolling ball based tilt switch 124 in the clamps 126, without moving or adjusting the support 120. Therefore, the angle of the longitudinal axis of the rolling ball based tilt switch 124 with respect to the angle of the longitudinal axis of the support 120 may be altered simply by rotating the housing 131 of the rolling ball based tilt switch 124 within the clamps 126. This effectuates changing of the angle of the longitudinal axis of the rolling ball based tilt switch 124 with respect to gravity without any moving, alteration, modification, changing, or adjusting of the support 120, making the rolling ball based tilt switch 124 a simple swap that is easy and simple for technicians to perform.

Figure 9:
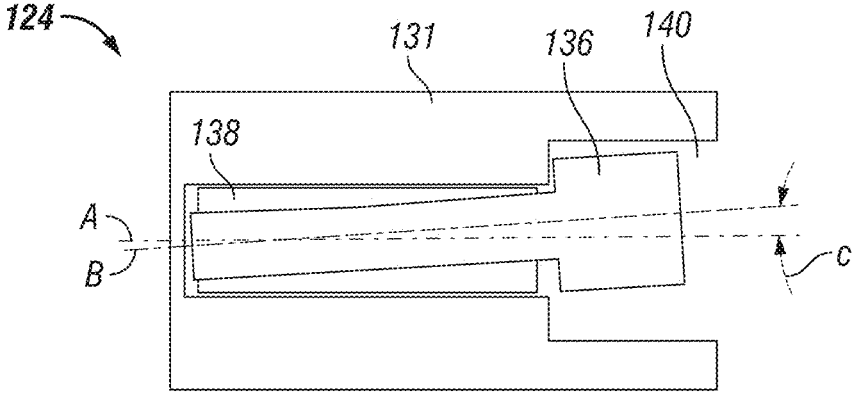
FIG. 9 is a cutaway view of another embodiment of replacement upper position detecting switches for use in FIGS. 1-2.

An alternative embodiment of the rolling ball based tilt switch 124 is shown in FIG. 9. Here, the longitudinal axis of the hole 140 is collinear with the longitudinal axis (reference A) of the housing 131. In addition, here, a sleeve 138 is positioned about the exterior of the rolling ball based tilt switch unit 136, and has a hole defined therein extending along a longitudinal axis (reference B) that is angled with respect to the longitudinal axis of the sleeve 138 itself, which is also collinear with the longitudinal axis (reference A) of the housing 131. Thus, rotation of the housing 131 still accomplishes the change of the angle of the longitudinal axis of the rolling ball based tilt switch 124 with respect to gravity, as with the embodiment of FIG. 8.

In other designs, the hole defined in the sleeve 138 may be parallel with the longitudinal axis of the sleeve 138, yet the exterior surface of the sleeve 138 itself may be cam shaped so that when the rolling ball based tilt switch unit 136, with sleeve 138 affixed, is inserted into the hole 140 of the housing 131, the longitudinal axis of the rolling ball based tilt switch unit 136 is angled with respect to the longitudinal axis of the housing 131, enabling the same adjustment of the angle of the longitudinal axis of the rolling ball based tilt switch 124 with respect to gravity as with the embodiments of FIGS. 8 and 9.

The steps taken by a technician to install the rolling ball based tilt switches 124 and 134 are as follows. First, the mechanical switch 102 is moved into a position in which both of the position detecting switch apparatuses 108 and 110 are open and there is sufficient room to permit disassembly thereof. Then, the old mercury based tilt switches are removed and replaced with the rolling ball based tilt switches 124 and 134. Next, a tester (shown as reference 154 in FIG. 10) is coupled across one of the switches 124, 134, and that switch is tested to verify that it opens and closes at precisely the same angle (of the support) as the removed switch. If it does not, the housing of that switch is rotated a given amount, and the testing is performed again. This is repeated until it is verified that the switch in question opens and closes at precisely the same angle as the removed switch. Then, this testing and adjusting procedure is repeated for the other switch.

It should be appreciated that there may be additional mercury tilt based switches in the breaker apparatus 100 that may be replaced with the rolling ball based tilt switch 124 and 134 as described above, together with the accompanying voltage converter 150 and relays 152 (if necessary).

In addition, in some cases, the tilt switch units 136 used may still be mercury switches, but containing less mercury than the conventional switches they replace. In such cases, the design of the switch 124 otherwise remains the same as described above. In fact, the tilt switch units may be of any type, and this disclosure is not meant to be limited to any particular type of tilt switches, and all suitable tilt switch designs are to be considered within the scope of this disclosure. In addition, although the above description is made with reference to an embodiment in which the mechanical breaker switch moves vertically to rack-in and to rack-out, it should be understood that this disclosure is usable with any mechanical breaker switch regardless of the direction of travel, including but not limited to horizontally racking mechanical breaker switches.

Figure 11A:
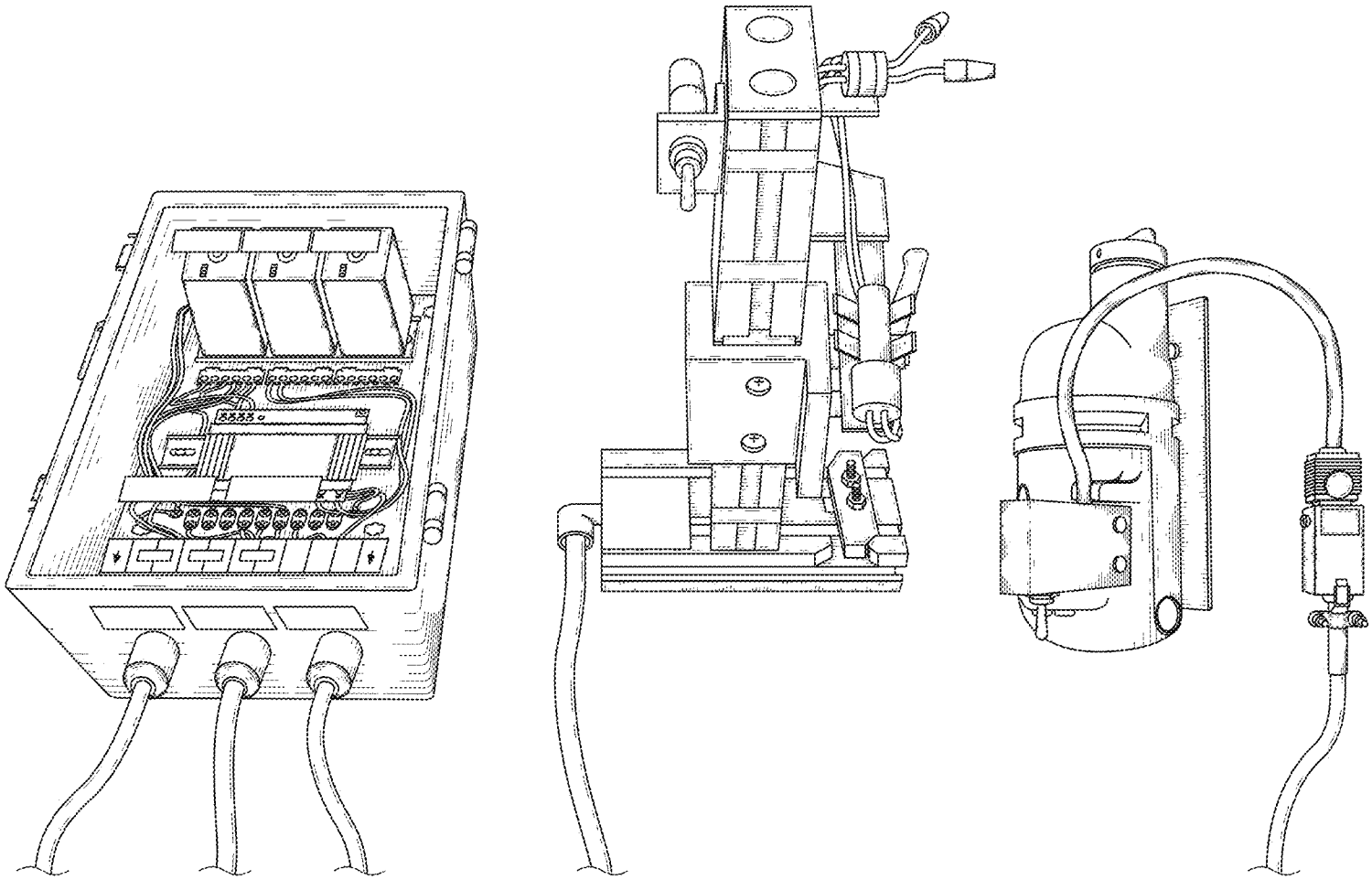
FIG. 11A is a front view of a prototype switch gear apparatus.
Figure 11B:
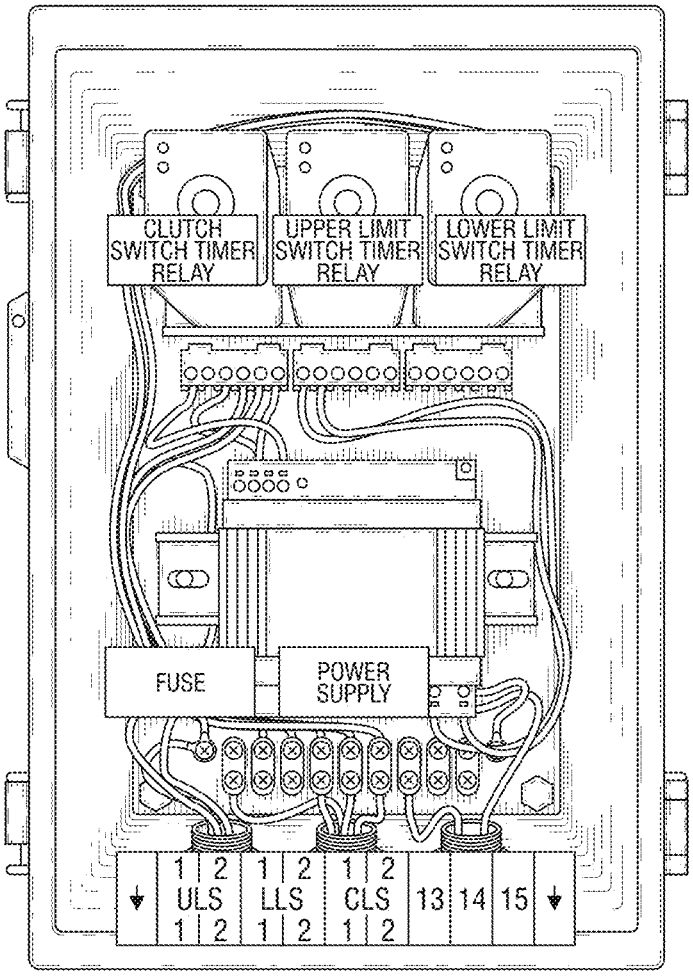
FIGS. 11B-11F are close up views of an exemplary electrical enclosure of the prototype switchgear apparatus of FIG. 11A.
Figure 11C:
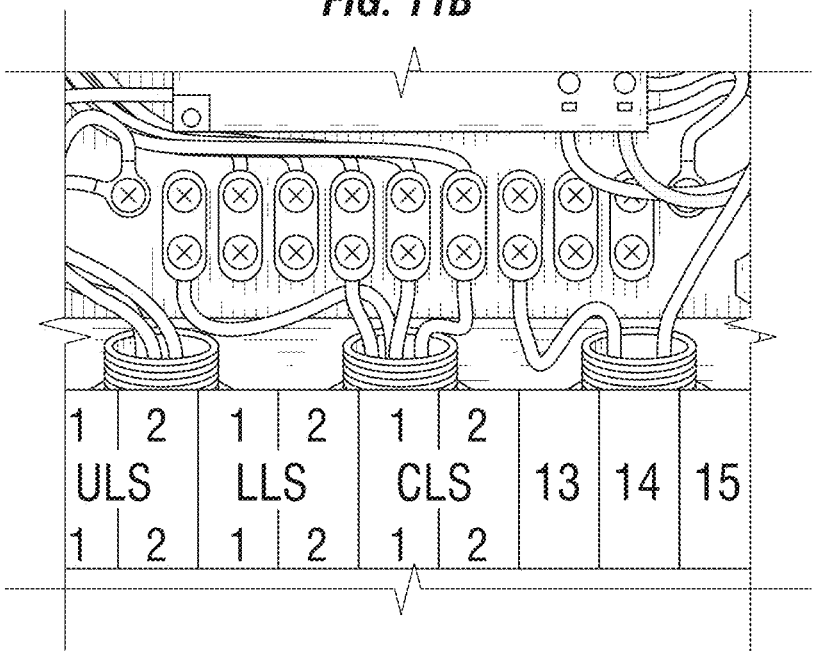
Figure 11D:
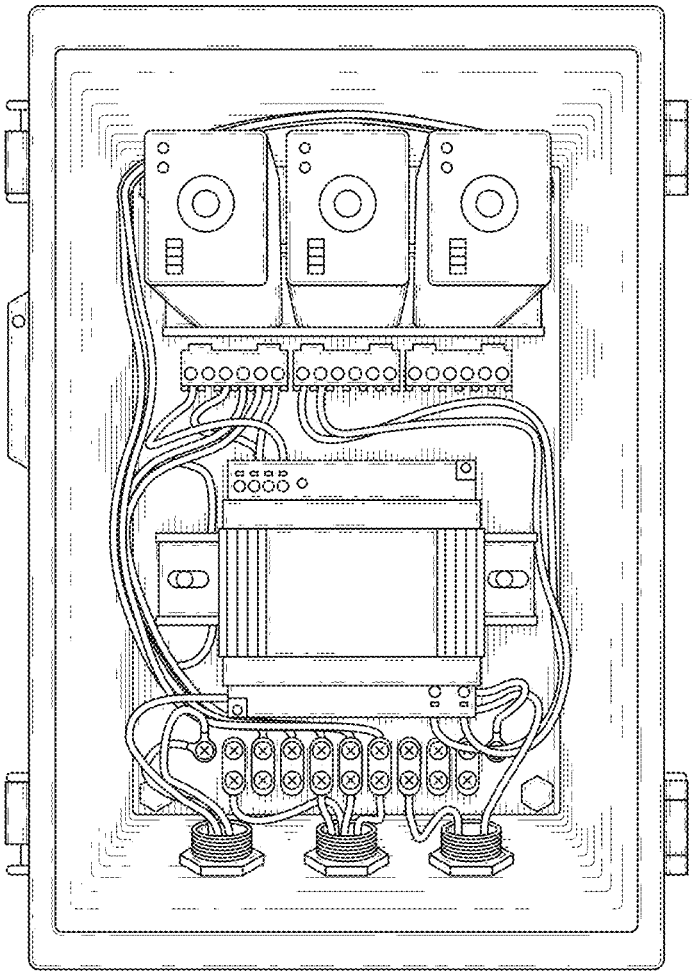
Figure 11E:
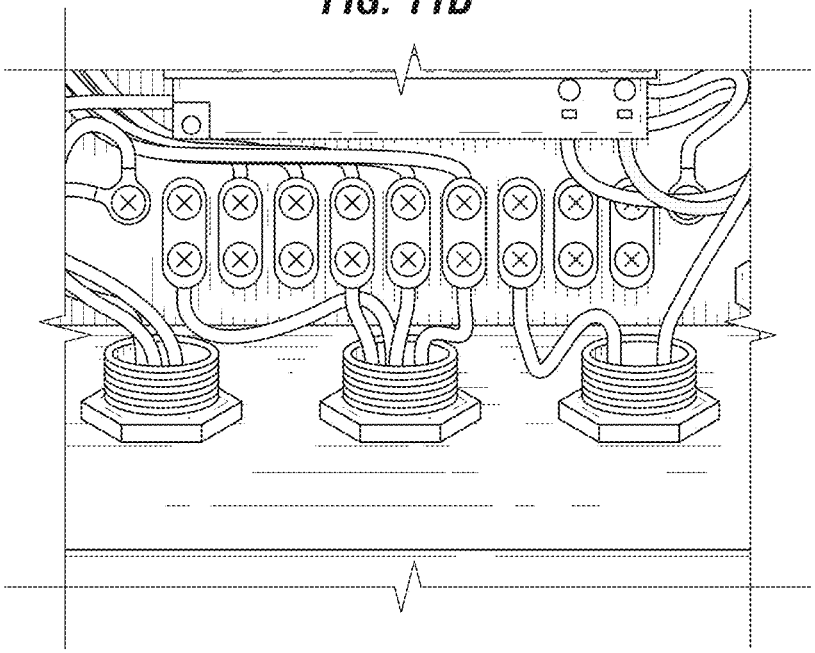
Figure 11F:
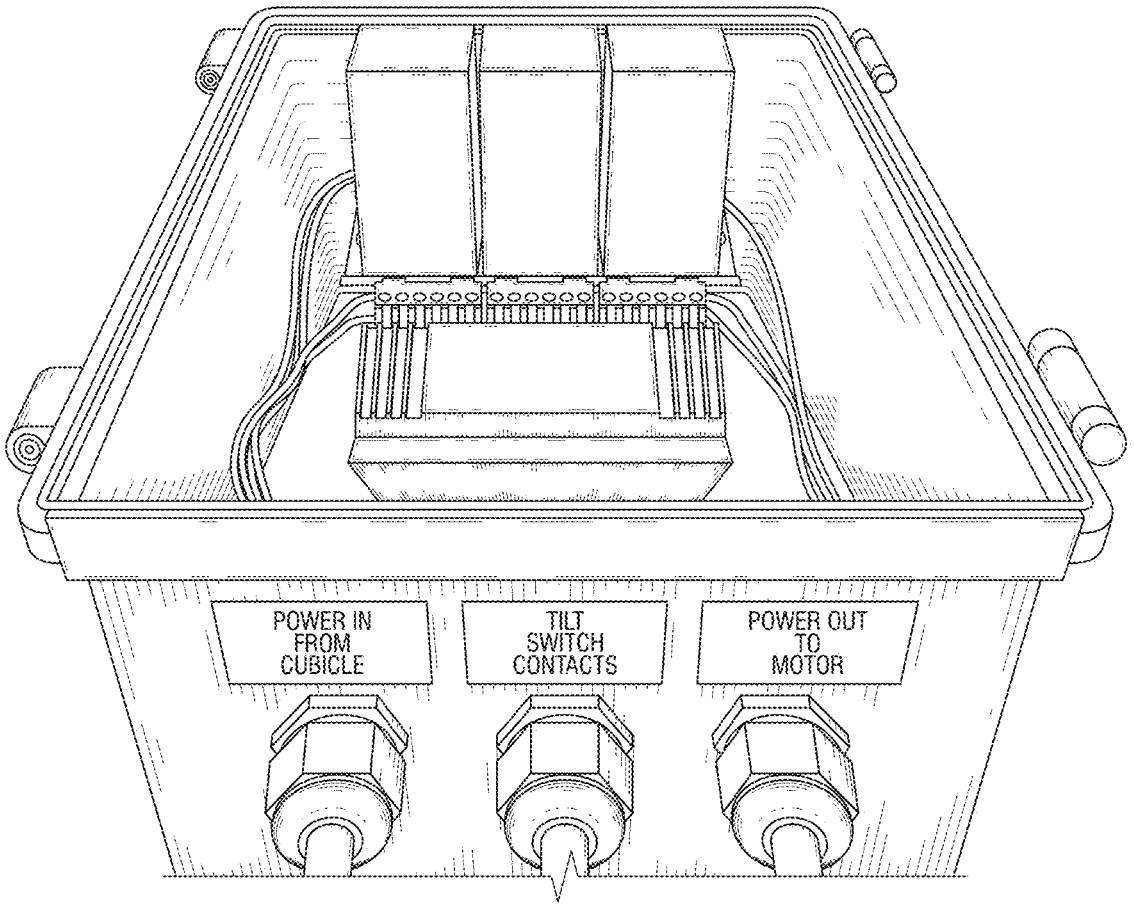
Figure 11H:
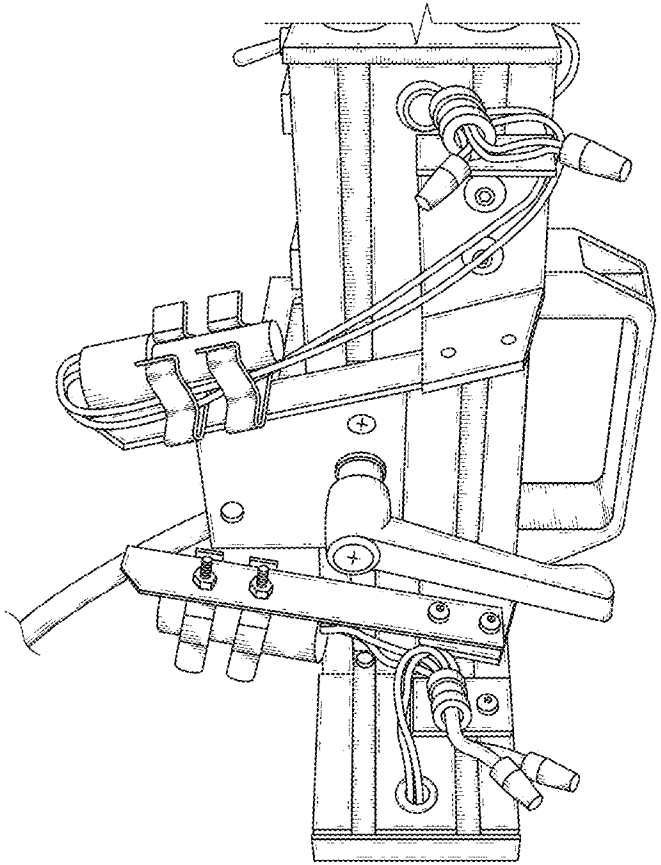
FIG. 11H is a close up side view of the exemplary switch subassembly of FIGS. 11A and 11G, showing exemplary replacement upper and lower position detecting switches.
Figure 11G:
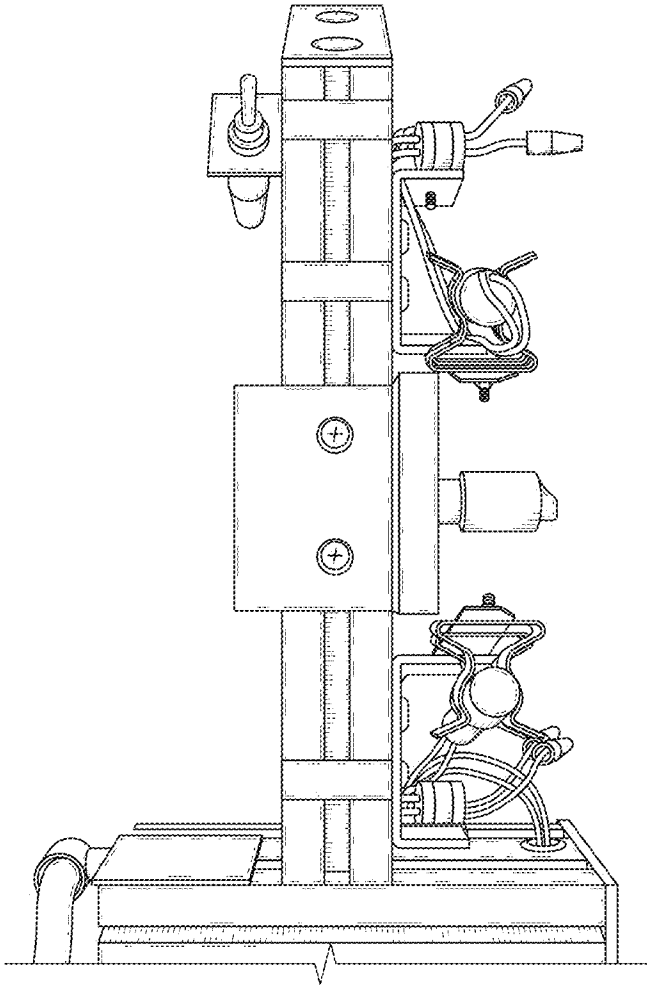
FIG. 11G is a close up view of an exemplary switch subassembly of the prototype switchgear apparatus FIG. 11A.
Figure 11I:
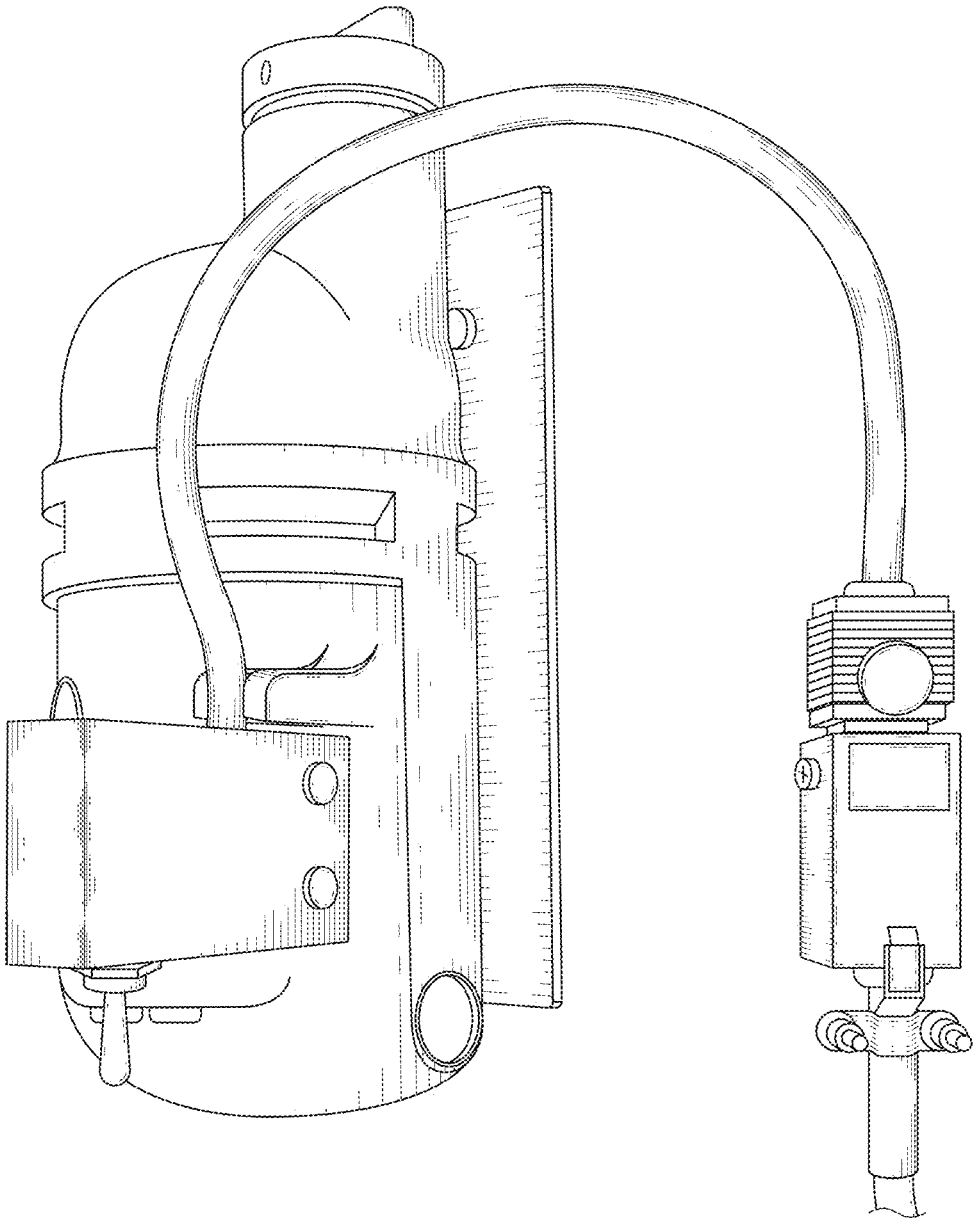
FIG. 11I is a close up view of the electric motor of FIG. 11A.

Additional details may be found as follows:

FIG. 11A is a front view of a prototype switch gear apparatus; FIGS. 11B-11F are close up views of an exemplary electrical enclosure of the prototype switchgear apparatus of FIG. 11A; FIG. 11G is a close up view of an exemplary switch subassembly of the prototype switchgear apparatus FIG. 11A; FIG. 11H is a close up side view of the exemplary switch subassembly of FIGS. 11A and 11G, showing exemplary replacement upper and lower position detecting switches; and FIG. 11I is a close up view of the electric motor of FIG. 11A.

Figure 12:
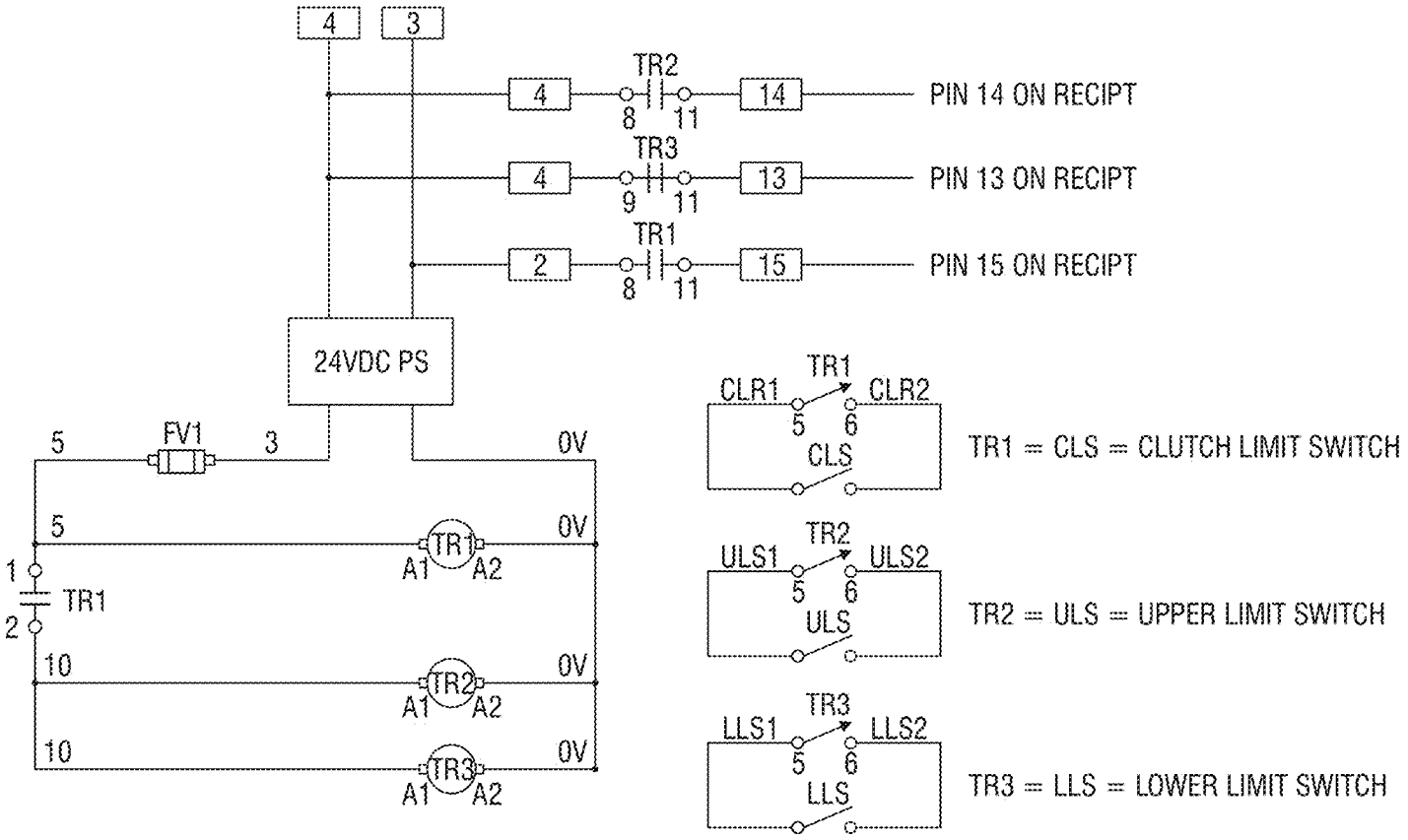
FIG. 12 is a circuit diagram of the control circuitry.

FIG. 12 is a circuit diagram of the control circuitry.

Figure 13A:
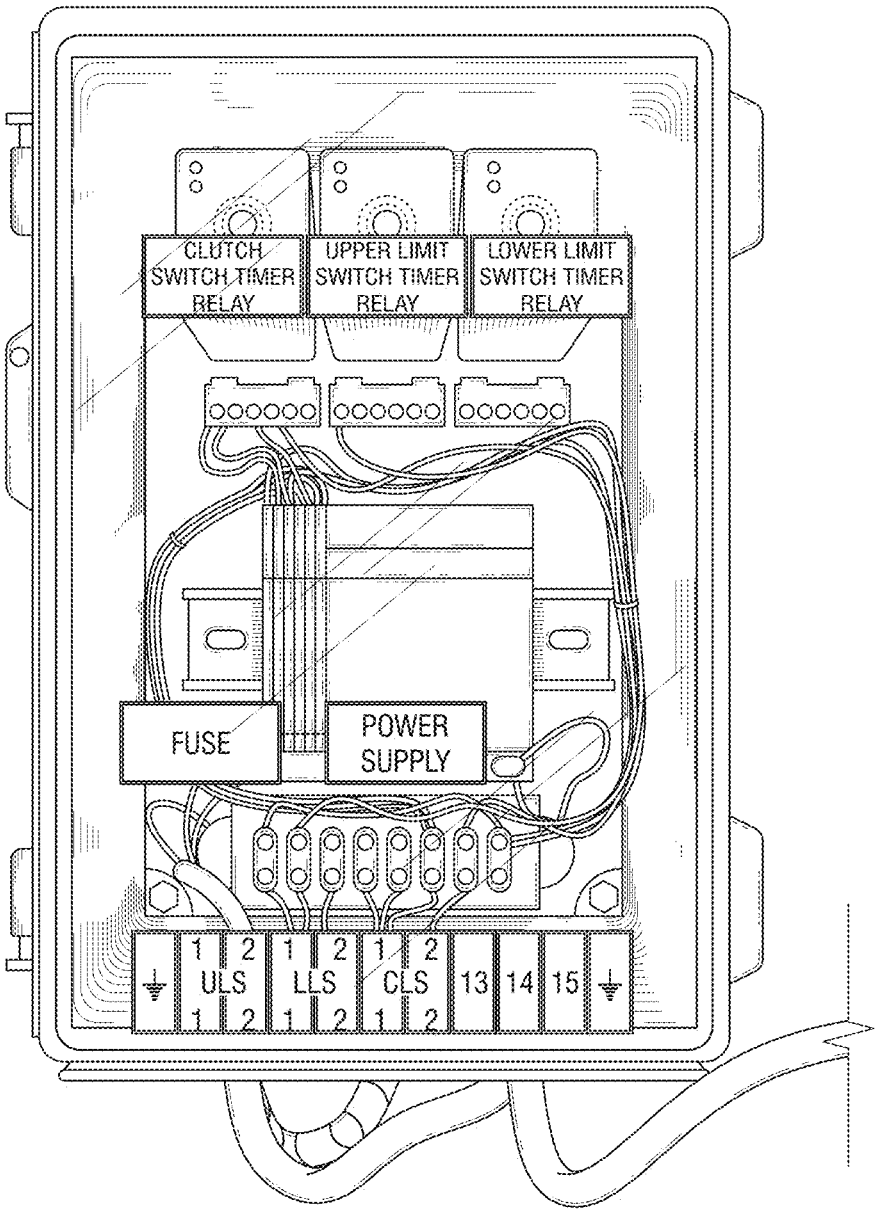
FIG. 13A is a front view of another exemplary electrical enclosure.
Figure 13B:
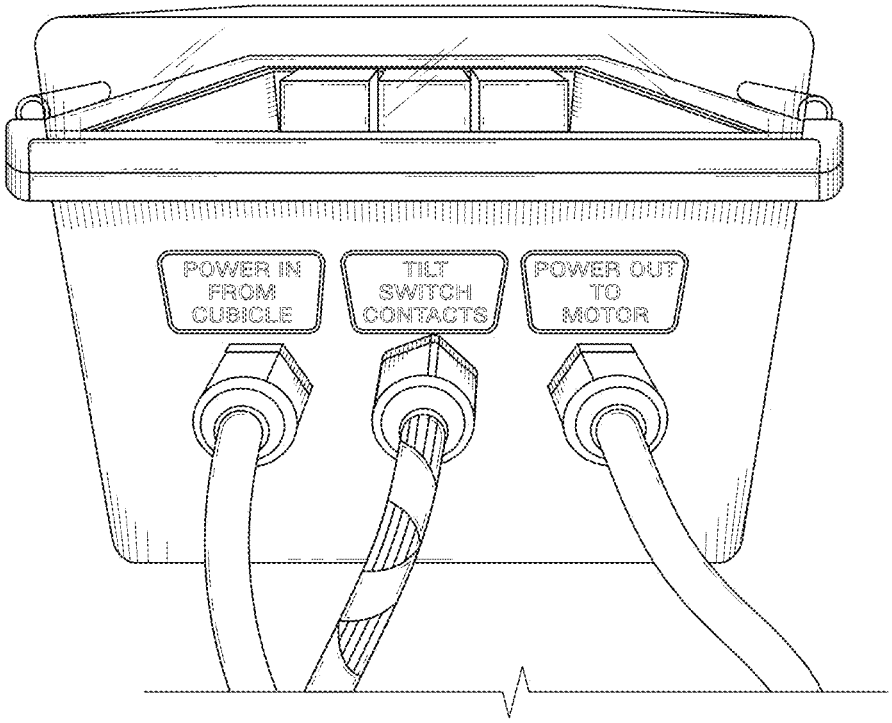
FIG. 13B is a bottom view of the exemplary electrical enclosure of FIG. 13A.
Figure 13C:
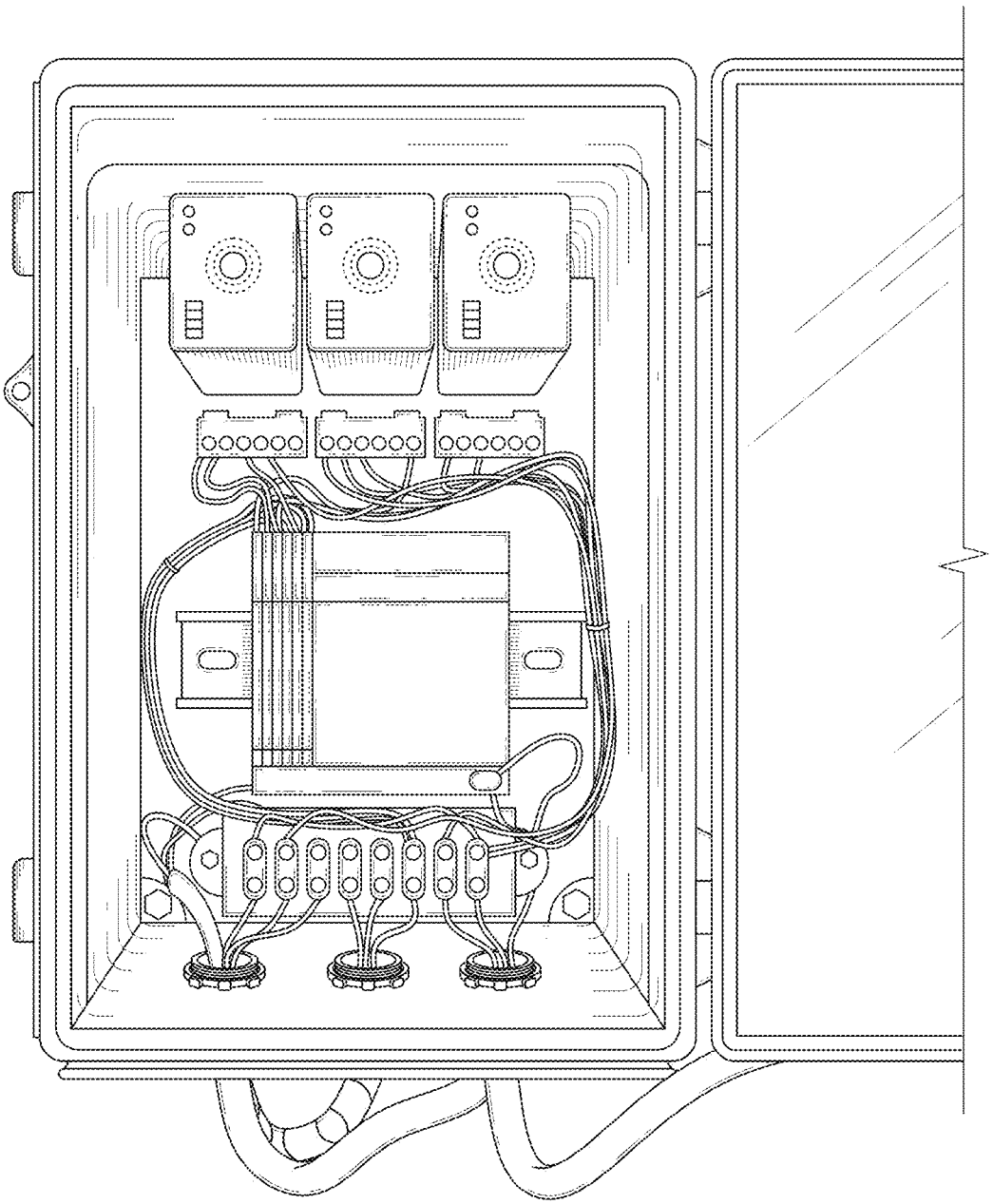
FIG. 13C is an interior view of the exemplary electrical enclosure of FIGS. 13A-13B.

FIG. 13A is a front view of another exemplary electrical enclosure; FIG. 13B is a bottom view of the exemplary electrical enclosure of FIG. 13A; and FIG. 13C is an interior view of the exemplary electrical enclosure of FIGS. 13A-13B.

Figure 14A:
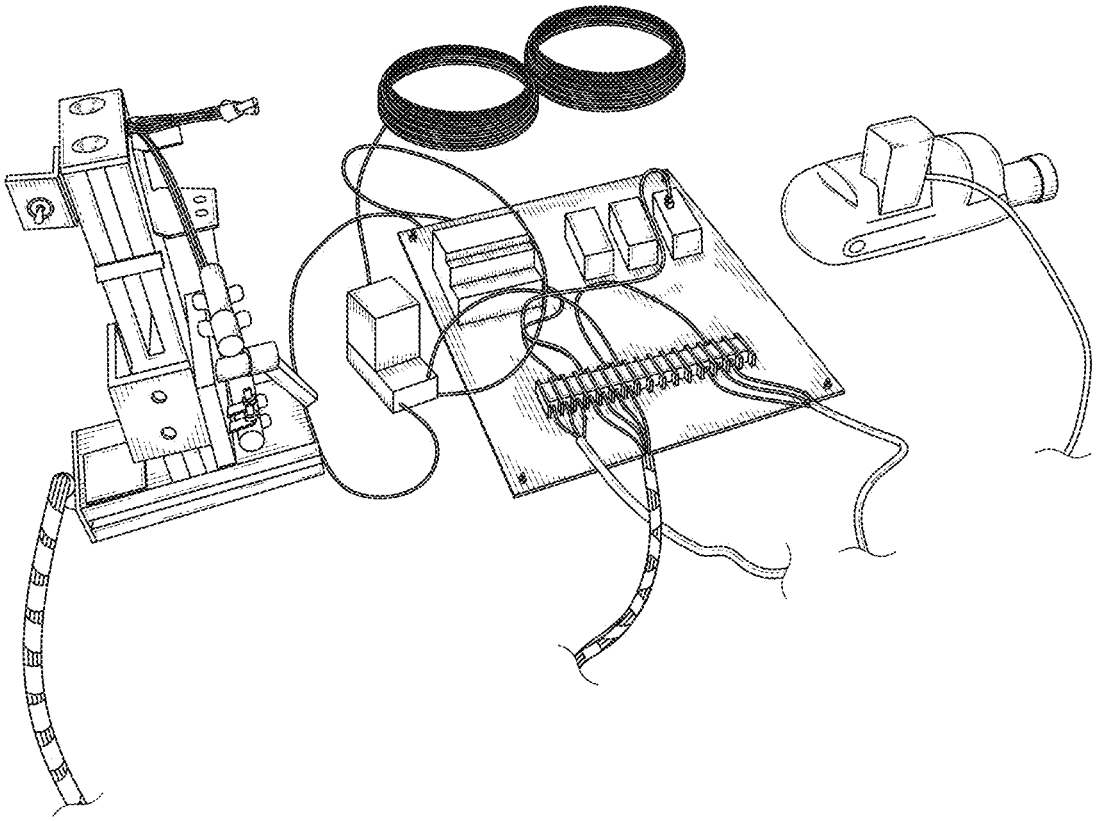
FIG. 14A is an upper perspective view of another prototype switchgear apparatus.
Figure 14B:
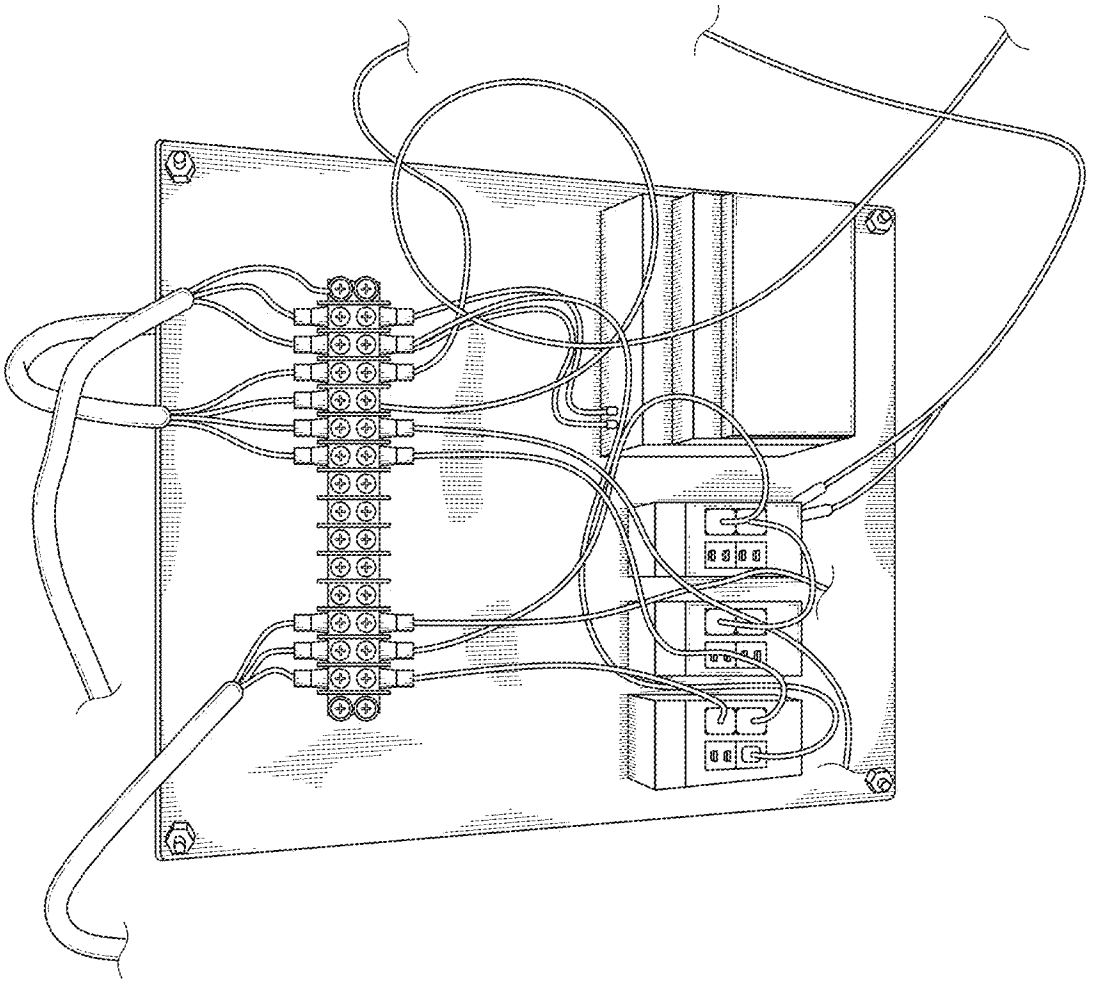
FIG. 14B is a close up view of exemplary control circuitry of the prototype switchgear apparatus of FIG. 14A.
Figure 14D:
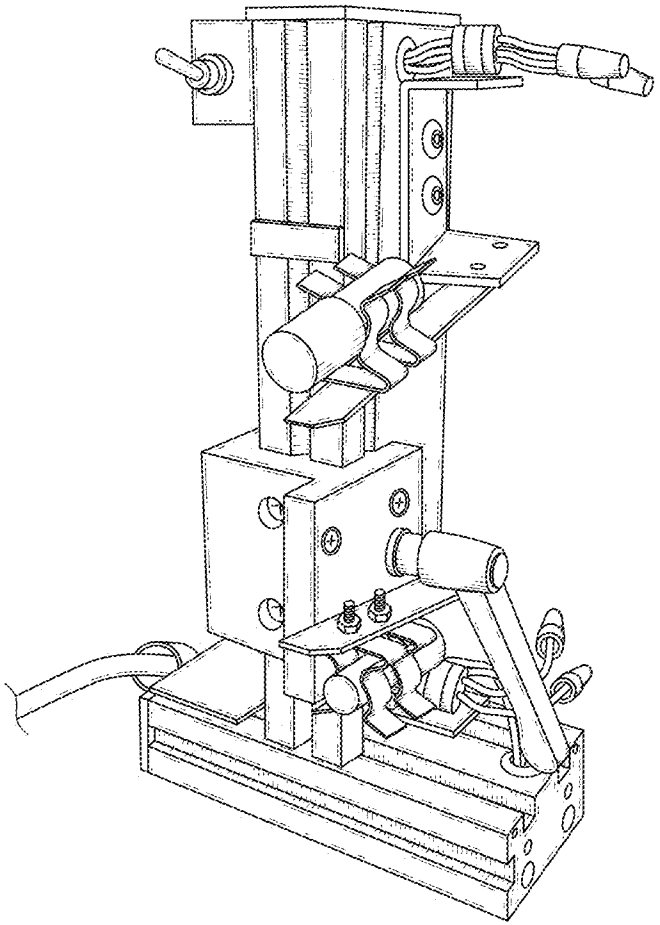
FIGS. 14C-14F are close up views of an exemplary switch subassembly of the prototype switchgear apparatus of FIG. 14A, showing exemplary replacement upper and lower position detecting switches.
Figure 14C:
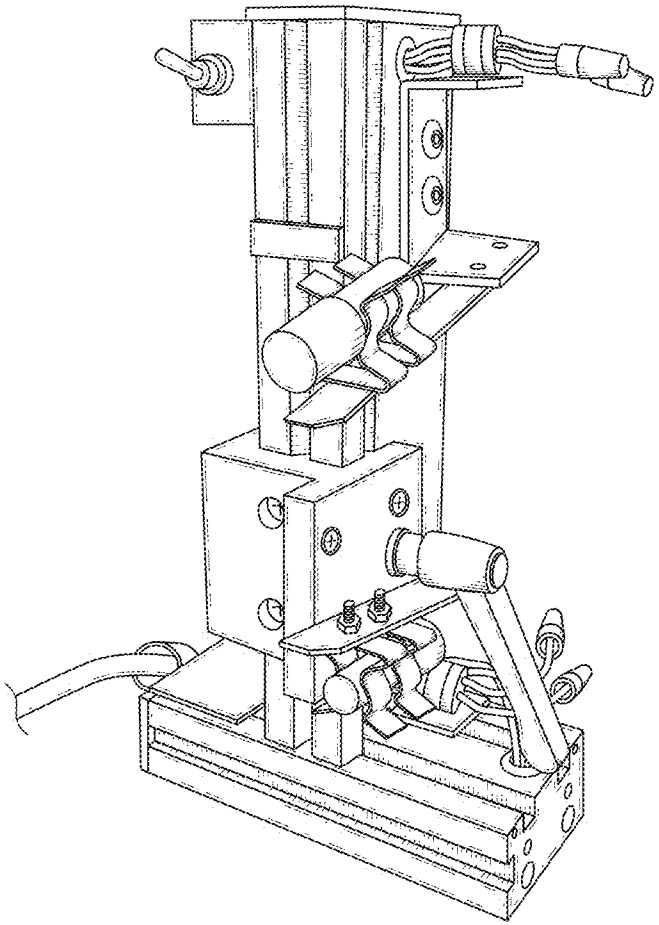
Figure 14E:
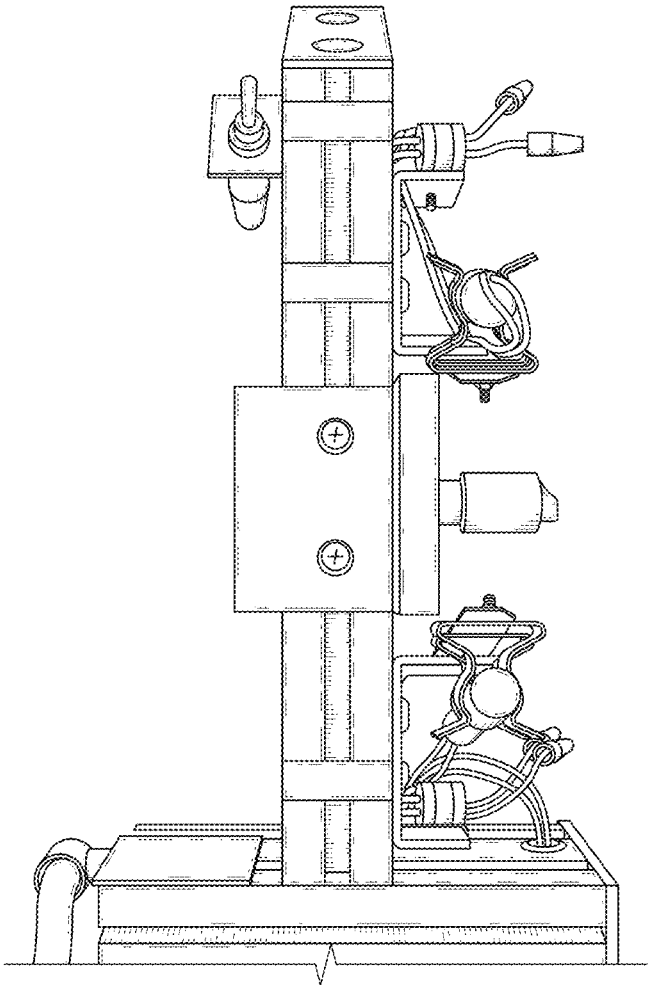
Figure 14F:
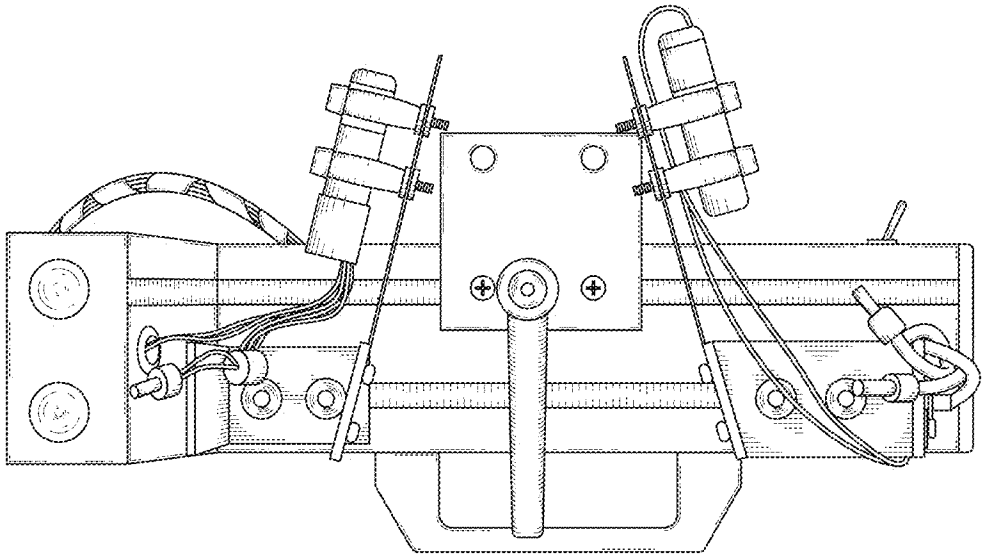

FIG. 14A is an upper perspective view of another prototype switchgear apparatus; FIG. 14B is a close up view of exemplary control circuitry of the prototype switchgear apparatus of FIG. 14A; and FIGS. 14C-14F are close up views of an exemplary switch subassembly of the prototype switchgear apparatus of FIG. 14A, showing exemplary replacement upper and lower position detecting switches.

The Inventor will offer a retrofit kit along with other switchgear solutions, including cell side elevating cell maintenance kits (e.g., worm gears, chains, bearings, clutch adapters, spring, etc.) cell side primary disconnects, replacement elevating motors, and a test kit. To aid users in the installation of the retrofit system, the replacement upper and lower position detecting switches are a direct replacement for existing mercury tilt switches. Rather than replacing an entire length of wire from the mercury tilt switches, the replacement upper and lower position detecting switches may be equipped with pre-terminated wires and a splice connection to minimize the effort required for installation. See e.g., FIG. 18.

Since the retrofit system will be using existing wiring from the replacement upper and lower position detecting switches to the electrical enclosure and the voltage converter will be drawing power from an elevating motor cubicle control circuit (and the replacement upper and lower position detecting switches and relays/contactors will be drawing power from the voltage converter, an electrical enclosure housing the voltage converter and relays/contactors will mount between the elevating motor cubicle control circuit voltage power supply and a plug supplying operating voltage to the elevating motor. See e.g., FIG. 15.

Figure 15:
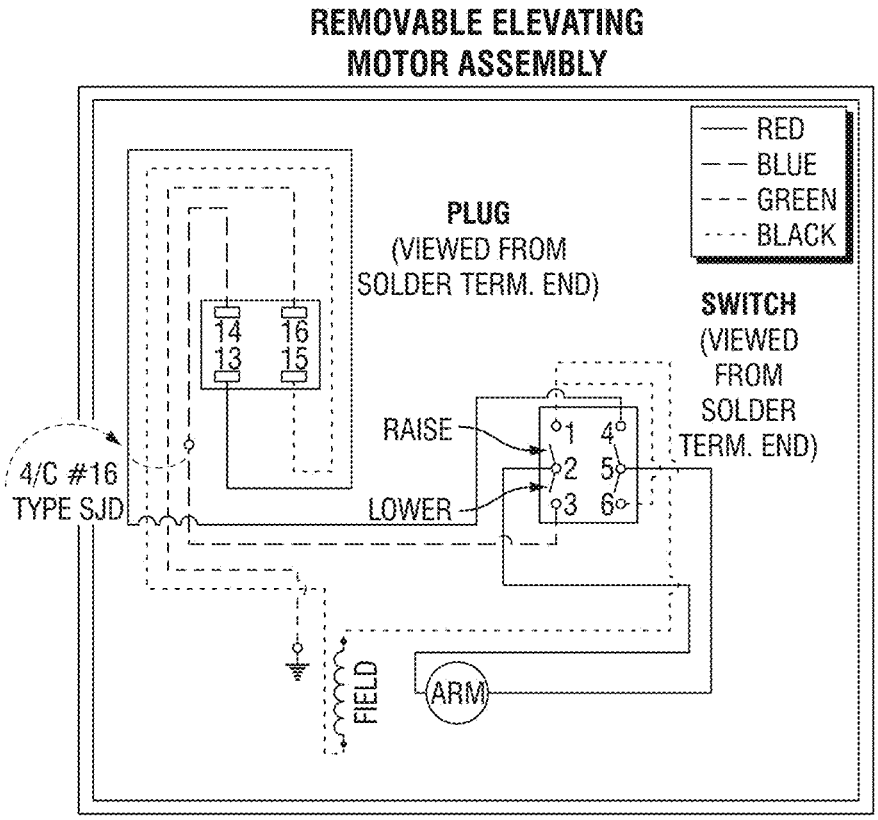
FIG. 15 is a circuit diagram of an exemplary elevating motor assembly, showing the circuit diagram for a General Electric Magne-blast and a General Electric M36 elevating motor.
Figure 16:
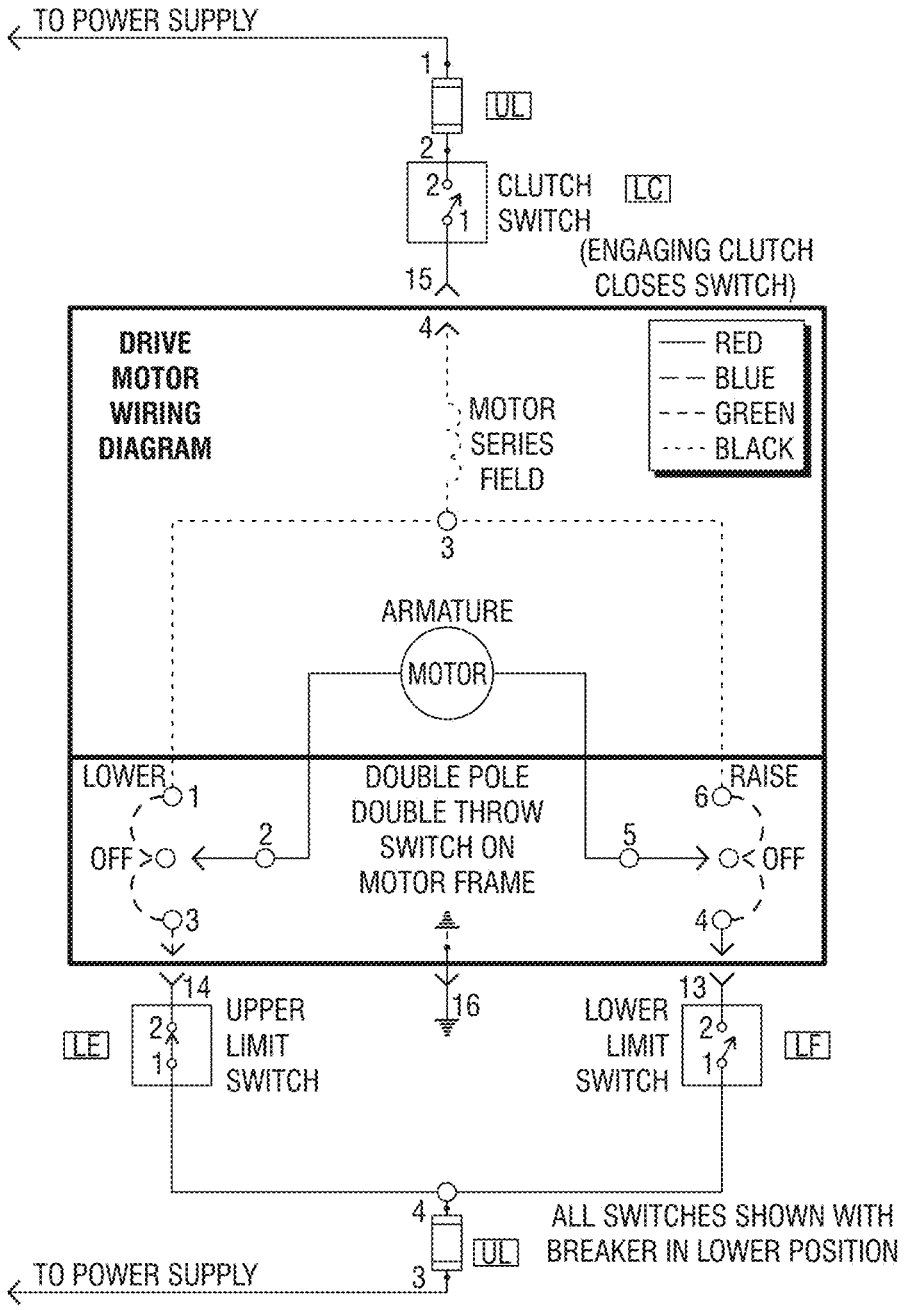
FIG. 16 is a circuit diagram of an exemplary electric drive motor.

FIG. 15 is a circuit diagram of an exemplary elevating motor assembly, showing the circuit diagram for a General Electric Magne-blast and a General Electric M36 elevating motor; and FIG. 16 is a circuit diagram of an exemplary electric drive motor.

The electrical enclosure may house the voltage converter and a circuit board housing the interposing relays/contactors for the voltage control of the elevating motor cubicle and current requirements of the elevating motor may be used to handle switching the elevating motor. The circuit board (and the interposing replays/contactors) will be drawing power from the voltage converter.

Figure 17:
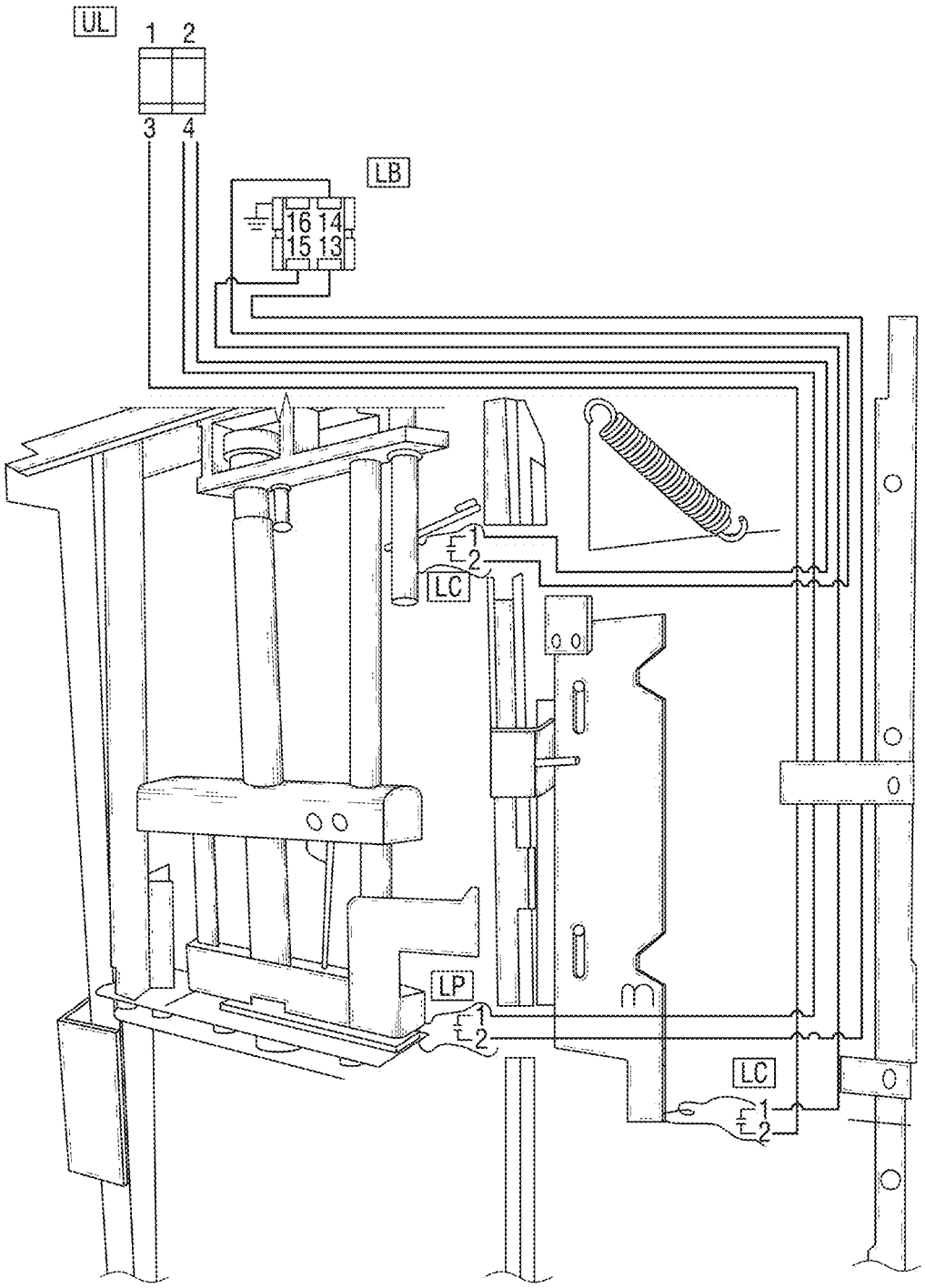
FIG. 17 is a circuit diagram of an exemplary elevating motor cubicle control assembly, showing the circuit diagram for a General Electric Magne-blast and General Electric M36 elevating motor.

The retrofit kit may be retrofitted into a General Electric Magne-blast or General electric M36 switchgear using a control scheme as shown in FIG. 17.

FIG. 17 is a circuit diagram of an exemplary elevating motor cubicle control assembly, showing the circuit diagram for a General Electric Magne-blast and General Electric M36 elevating motor.

Figure 18:
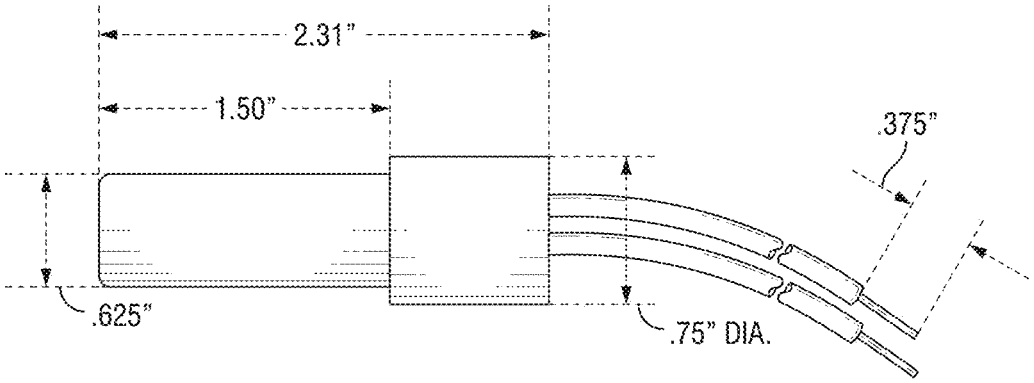
FIG. 18 is a side view of the replacement upper position detecting devices.

FIG. 18 is a side view of the replacement upper position detecting devices. As shown in FIG. 18, the replacement upper and lower position detecting device may be about 2.31 inches long. The replacement upper and lower position detecting device has a first portion and a second portion. The first portion may be about 0.625 inches in diameter and about 1.50 inches long. The second portion may be about 0.75 inches in diameter and about 0.81 inches long.

The replacement upper and lower position detecting device has a first wire having a first end and a second wire having a second end. About 0.375 inches of insulation may be removed from the first end of the first wire and from the second end of the second wire.

Although the preceding description has been described herein with reference to particular circuits and embodiments, it is not intended to be limited to the particulars disclosed herein; rather, it extends to all functionally equivalent structures, methods, and uses, such as are within the scope of the appended claims.

The embodiments and examples set forth herein are presented to best explain the present invention and its practical application and to thereby enable those skilled in the art to make and utilize the invention. However, those skilled in the art will recognize that the foregoing description and examples have been presented for the purpose of illustration and example only. The description as set forth is not intended to be exhaustive or to limit the invention to the precise form disclosed. Many modifications and variations are possible in light of the above teaching without departing from the spirit and scope of the following claims. The invention is specifically intended to be as broad as the claims below and their equivalents.

Definitions

As used herein, the terms "a," "an," "the," and "said" means one or more, unless the context dictates otherwise.

As used herein, the term "about" means the stated value plus or minus a margin of error or plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

INCORPORATION BY REFERENCE

All patents and patent applications, articles, reports, and other documents cited herein are fully incorporated by reference to the extent they are not inconsistent with this invention.

What is claimed is:

1. An apparatus comprising:

a housing having a central opening defined therein; and a detection apparatus comprising:

a first support biased towards a second position of a mechanical breaker switch;

a tilt activated switch disposed within the central opening of the housing and carried by the first support and for indicating whether the mechanical breaker switch is in a first position, the tilt activated switch rated to handle a second voltage less than a first voltage;

wherein the central opening is angled with respect to a longitudinal axis of the housing such that rotation of the housing changes the angle of the tilt activated switch with respect to gravity; and wherein the tilt activated switch is adjustable so as to permit change of an angle thereof with respect to gravity without changing an angle of the first support with respect to gravity.

2. The apparatus of claim 1, wherein the tilt activated switch is of a rolling ball type.

3. The apparatus of claim 1, wherein the tilt activated switch is of a mercury type.

4. The apparatus of claim 1, further comprising control circuitry coupled to the tilt activated switch and enabling the tilt activated switch to serve a load requiring the first voltage greater than the second voltage.

5. The apparatus of claim 1, wherein the control circuitry comprises:

a voltage converter configured to convert the first voltage to the second voltage, and coupled between the first voltage and the mechanical breaker switch; and a relay circuit actuated by the mechanical breaker switch and configured to switch an electric motor.

6. A method of replacing position detecting switches in an apparatus, the method comprising:

providing the apparatus of claim 1;

moving the mechanical breaker switch to a position permitting removal of a first position detecting switch from a first support, the first position detecting switch indicating whether a mechanical breaker switch is in the first position by transitioning between first and second states when disposed at or greater than a first threshold angle with respect to gravity;

removing the first position detecting switch;

replacing the first position detecting switch with a first replacement position detecting switch without adjusting an angle of the first support with respect to gravity; and adjusting the first replacement position detecting switch such that it transitions between the first and second states at when disposed at or greater than the first threshold angle with respect to gravity, without adjusting the angle of the first support with respect to gravity.

7. A breaker apparatus comprising:

a mechanical breaker switch movable between first and second positions;

an electric motor configured to move the mechanical breaker switch between the first and second positions when powered by a first voltage;

a first position detection apparatus comprising:

a first support biased toward the second position of the mechanical breaker switch;

a first position detecting switch carried by the first support and for indicating whether the mechanical breaker switch is in the first position, the first position detecting switch rated to handle a second voltage less than the first voltage;

wherein the first position detecting switch is adjustable so as to permit change of an angle thereof with respect to gravity without changing an angle of the first support with respect to gravity; and a control circuitry comprising:

a voltage converter coupled between the first voltage and the mechanical breaker switch, the voltage converter configured to convert the first voltage to the second voltage;

and a relay circuit actuated by the mechanical breaker switch and configured to switch the electric motor.

8. The breaker apparatus of claim 7, wherein the first position detecting switch comprises:

a housing having a central opening defined therein; and a tilt activated switch disposed within the central opening of the housing;

wherein the central opening is angled with respect to a longitudinal axis of the housing such that rotation of the housing changes the angle of the tilt activated switch with respect to gravity.

9. The breaker apparatus of claim 7, wherein the first position detecting switch comprises:

a housing having a central opening defined therein; and a tilt activated switch disposed within the central opening of the housing;

wherein the housing is shaped such that rotation thereof changes the angle of the tilt activated switch with respect to gravity.

10. The breaker apparatus of claim 7, wherein the first position detecting switch comprises:

a housing having a central opening defined therein;

a removable sleeve disposed about the housing; and a tilt activated switch disposed within the central opening of the housing;

wherein the removable sleeve is shaped such that rotation of the housing changes the angle of the tilt activated switch with respect to gravity.

11. The breaker apparatus of claim 7, further comprising a second position detection apparatus comprising:

a second support biased toward the first position of the mechanical breaker switch;

a second position detecting switch carried by the second support and for indicating whether the mechanical breaker switch is in the second position, the first position detecting switch rated to handle the second voltage;

wherein the second position detecting switch is adjustable so as to permit change of an angle thereof with respect to gravity without changing an angle of the second support with respect to gravity.

12. A method of replacing position detecting switches in a breaker apparatus, the method comprising:

providing the breaker apparatus of claim 7;

moving the mechanical breaker switch to a position permitting removal of a first position detecting switch from a first support, the first position detecting switch indicating whether the mechanical breaker switch is in the first position by transitioning between first and second states when disposed at or greater than a first threshold angle with respect to gravity;

removing the first position detecting switch;

replacing the first position detecting switch with a first replacement position detecting switch without adjusting an angle of the first support with respect to gravity; and adjusting the first replacement position detecting switch such that it transitions between the first and second states at when disposed at or greater than the first threshold angle with respect to gravity, without adjusting the angle of the first support with respect to gravity.

* * * * *